US006540317B1

(12) United States Patent
Okamoto et al.

(10) Patent No.: US 6,540,317 B1
(45) Date of Patent: Apr. 1, 2003

(54) PRINTER HEAD, INK JET PRINTER AND METHOD FOR DRIVING PRINTER HEAD

(75) Inventors: Kenji Okamoto, Tokyo (JP); Emi Yamada, Tokyo (JP); Makoto Ando, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/631,514

(22) Filed: Aug. 3, 2000

(30) Foreign Application Priority Data

Aug. 3, 1999 (JP) ..... 11-220469

(51) Int. Cl.[7] ..... B41J 2/205; B41J 2/015; B41J 2/135; B41J 2/175

(52) U.S. Cl. ..... 347/15; 347/21; 347/43; 347/85

(58) Field of Search ..... 347/15, 21, 43, 347/85, 20, 101

(56) References Cited

U.S. PATENT DOCUMENTS 5,777,636 A * 7/1998 Naganuma et al. ..... 347/10
5,980,014 A * 11/1999 Kagami ..... 347/15
6,003,972 A * 12/1999 Narushima ..... 347/41
6,036,295 A * 3/2000 Ando et al. ..... 347/15
6,142,597 A * 11/2000 Kagami ..... 347/44
6,158,842 A * 12/2000 Ando et al. ..... 347/45
6,402,295 B1 * 6/2002 Narushima ..... 347/12

* cited by examiner

*Primary Examiner*—John Barlow
*Assistant Examiner*—Leonard Liang
(74) *Attorney, Agent, or Firm*—Sonnenschein, Nath & Rosenthal

(57) ABSTRACT

There is provided a printer head in an ink jet printer that includes: a quantification medium pressuring chamber where a quantification medium is introduced; a discharge medium pressuring chamber where a discharge medium is introduced; a quantification medium nozzle communicating with the quantification medium pressuring chamber; a discharge medium nozzle communicating with the discharge medium pressuring chamber, the discharge medium nozzle being disposed to adjoin the quantification medium nozzle; and a first pressure generating element pulling the quantification medium pushed out of the quantification medium nozzle into the discharge medium nozzle to form a mixed solution by contacting the quantification medium in the discharge medium nozzle through a surface where the quantification medium nozzle opens, wherein the first pressure generating element then generates a pressure for discharging the mixed solution from the discharge medium nozzle.

13 Claims, 25 Drawing Sheets

PRINTER HEAD, INK JET PRINTER AND METHOD FOR DRIVING PRINTER HEAD

BACKGROUND OF THE INVENTION

1. Field of the Invention

The present invention relates to a printer head, an ink jet printer and a method for driving the printer head.

2. Description of the Related Art

It has recently become widespread to draw up documents on computers that are used as desktop publishers, especially in offices. And lately demands for outputting not only characters and graphics but also colored natural pictures like photographs together with them has become increased. Therefore, it has been required to print high quality natural pictures, and gradation expression with the expression of halftones has consequently becomes important.

Furthermore, the so-called on demand type printers have been coming into wide use in recent years because they are suitable for miniaturization and reduction in cost. The on demand type printers perform recording by discharging ink droplets from nozzles only when it is required to print according to control signals that are in compliance with recording signals to make the ink droplets adhere on a material to be recorded, such as a sheet of paper or a film.

As aforesaid, although various methods as a method for discharging ink droplets from nozzles have been proposed, a method using a piezoelectric element or a heating element is generally used. The former is a method for discharging ink by applying pressure to it by means of the deformation of the piezoelectric element. The latter is a method for discharging ink by the pressure of bubbles produced by vaporizing the ink in nozzles by the heat generated by the heating element.

In addition, various methods have been proposed as a method for mimetically realizing the aforementioned gradation expression with the expression of halftones on the aforementioned on demand type printer that discharges ink droplets. That is, as a first method, there is a method that expresses the halftone gradation by controlling the sizes of the ink droplets to be discharged by varying the voltage value or the pulse width of a pulse voltage to be supplied to the piezoelectric element or the heating element to make diameters of dots to be printed variable.

However, the above first method has a defect that expressible gradation steps are not many, in particular, the expression of low density is very difficult, because there is a limit to the minimum diameter of the droplets owing to the fact that, if the voltage or the pulse width supplied to the piezoelectric element or the heating element is decreased too much, the ink is not discharged. Consequently, the first method is not satisfactory for a printout of a natural picture.

Besides, as a second method, there is a method that realizes a gradation expression by constituting one pixel with a matrix composed of e.g. 4×4 dots without varying the diameters of the dots, and by performing the picture processing such as the so-called dither method or the error diffusion method of each matrix.

However, although seventeen gradation steps of the density can be expressed by the second method if one pixel is composed of the 4×4 matrix, the resolution of a printed picture deteriorates to one fourth if the picture is printed, for example, at the dot density same as that of the first method. Consequently, the printed picture becomes conspicuous in roughness, and thus the second method is also not satisfactory for a printout of a natural picture.

Accordingly, for principally resolving the problems of the conventional on demand type printers, the inventors of the present invention have proposed such a printer as was described in, for example, JP-A 201024/93 and JP-A 195682/95, which printer mixes ink and diluent, i.e. a transparent solvent, together at a predetermined mixing ratio just before discharging to be diluent ink, and immediately discharges the diluent ink from nozzles to make it adhere on a material to be recorded for recording.

Although, in the following description, the system in which ink is used as a quantification medium and diluent is used as a discharge medium, and in which the ink as the quantification medium is mixed with the diluent as the discharge medium to be the diluent ink, and further in which recording is done by discharging the discharge medium, is called as a carrier jet system among the aforementioned systems, there is no problem in a printer even if the diluent is used as the quantification medium and the ink is used as the discharge medium.

A printer in accordance with such a carrier jet system can control the density of the mixed solution to be discharged by varying the mixing ration of the ink and the diluent by varying the amount of the quantification medium that is either the ink or the diluent, and then the printer can separately vary the density of every dot to be printed. Consequently, the printer can print out a natural picture rich in the halftone gradation thereof without producing the deterioration of its resolution.

As a two liquids mixing type printer as stated above, there is the so-called external mixing type printer as will be shown in the following, for example.

The printer includes a quantification medium pressuring chamber where a quantification medium is introduced and a discharge medium pressuring chamber where a discharge medium is introduced. An opening of a quantification medium nozzle communicating with the quantification medium pressuring chamber and an opening of a discharge medium nozzle communicating with the discharge medium pressuring chamber adjoin to each other. The printer oozes the quantification medium from the quantification medium nozzle through the opening surface of the nozzle to the discharge medium nozzle, and makes the oozed quantification medium contact with the discharge medium plugged in the vicinity of the tip of the discharge medium nozzle to form the mixed solution. And then, the printer discharges the discharge medium from the discharge nozzle to discharge the quantification medium and the discharge medium as the mixed solution.

In such a structure, because the qualification nozzle and the discharge nozzle are separately formed, the quantification medium and the discharge medium do not diffuse while they are waiting for being discharged, and mutual affluxes at the time of mixing and discharging can be prevented.

When printing is done by the printer head shown in FIG. 21, it is done along the following description. The description is now done by making use of a timing chart for the imposition of driving voltages shown in FIG. 22. The so-called laminated type piezoelectric elements are used as a first laminated type piezoelectric element 43 and a second laminated type piezoelectric element 44. There are two types of laminated type piezoelectric elements, one of them utilizes the displacement thereof in the shrinking direction (the so-called d-31 direction), and the other utilizes the displacement thereof in the elongating direction (the so-called d-33 direction). The latter is used as both of the first laminated type piezoelectric element 43 and the second laminated type piezoelectric element 44.

As shown in the timing chart of the imposition of the driving voltages of FIG. 22, at first, at a point of time indicated by reference character (a) in FIG. 22, positive voltages, 10 V for the first laminated type piezoelectric element 43 and 15 V for the second laminated type piezoelectric element 44, are being imposed on them as driving voltages. The horizontal axis of FIG. 22 indicates time, and the vertical axis of FIG. 22 indicates driving voltages for the first laminated type piezoelectric element 43 and the second laminated type piezoelectric element 44. At this time, a quantification medium 45 and a discharge medium 49 are in their waiting state shown in FIG. 23(A).

Next, at a point of time indicated by reference character (b) in FIG. 22, the driving voltage for the first laminated type piezoelectric element 43 starts to be lowered until a point of time indicated by reference character (d) in FIG. 22 to be 0 V over a period of 50 μs. Then, the first laminated type piezoelectric element 43 is elongated to push the touching part of a diaphragm 42 out. As a result, the volume of a quantification medium pressuring chamber 56 decreases. Consequently, at a point of time indicated by reference character (c) in FIG. 22 that is within an intermediate period between the point of time indicated by reference character (b) in FIG. 22 and the point of time indicated by reference character (d) in FIG. 22, the quantification medium 45 is pushed out of a quantification medium nozzle 53 as mimetically shown in FIG. 23(B). In the present case, because the quantification medium nozzle 53 is formed so as to gradually approaches to a discharge medium nozzle 54, the quantification medium 45 is pushed out to the discharge medium nozzle 54.

This state is kept for the period of 50 μs from the point of time indicated by reference character (d) in FIG. 22 to the point of time indicated by reference character (e) in FIG. 22. As a result, at the point of time indicated by reference character (e) in FIG. 22, as shown in FIG. 23(C), the quantification medium 45 becomes a state of being coupled to the discharge medium 49 after the quantification medium being contacted to the discharge medium 49.

From the point of time indicated by reference character (e) in FIG. 22, the driving voltage of the first laminated type piezoelectric element 43 is gradually raised to the initial value. Then, since the first laminated type piezoelectric element again shrinks, the volume of the quantification medium pressuring chamber 56 increases so that the quantification medium 45 begins to be pulled into the quantification medium nozzle 53.

As shown in FIG. 24(A), the meniscus of the ink remaining on the discharge medium nozzle 54 in a state of being swollen thereon after being torn off, as shown in FIG. 24(B), comes into a waiting state by the capillary attraction of a mixed solution 69 that is produced by the mixture of the meniscus and the diluent in the discharge medium nozzle 54.

For a period from a point of time indicated by reference character (f) in FIG. 22, which point is later than the point of time indicated by reference character (e) in FIG. 22, to a point of time indicated by reference character (g) in FIG. 22, the driving voltage for the second laminated type piezoelectric element 44 is lowered from 15 V to 0 V over a period of 10 μs. Then, the second laminated type piezoelectric element 44 is elongated to push the touching part of the diaphragm 42 out. As a result, the volume of a discharge medium pressuring chamber 58 decreases. Consequently, at the point of time indicated by reference character (f) in FIG. 22, the mixed solution 69 begins to be pushed out of the discharge medium nozzle 54 as mimetically shown in FIG. 24(C).

This state is kept for the period of 50 μs from the point of time indicated by reference character (g) in FIG. 22 to a point of time indicated by reference character (i) in FIG. 22. As a result, at a point of time indicated by reference character (h) in FIG. 22 that is within an intermediate period between the point of time indicated by reference character (g) in FIG. 22 and the point of time indicated by reference character (i) in FIG. 22, as shown in FIG. 25(A), the mixed solution 69 becomes a state of being further pushed out of the discharge medium nozzle 54.

On the other hand, since the driving voltage of the first laminated type piezoelectric element 43 continues to rise, the quantification medium 45 is being pulled into the quantification medium nozzle 53 so that the part contacting with the discharge medium 49 is left.

The driving voltage of the second laminated type piezoelectric element 44 begins to rise gradually from the point of time indicated by reference character (i) in FIG. 22. Then, the second laminated type piezoelectric element 44 again starts to shrink so that the volume of the discharge medium pressuring chamber 58 begins to increase. As a result, at a point of time indicated by reference character (j) in FIG. 22 that is a point of time a little later than the point of time indicated by reference character (i) in FIG. 22, as mimetically shown in FIG. 25(B), a constriction begins to be produced between the mixed solution 69 and the discharge medium 49. Incidentally, at the point of time, the driving voltage of the first laminated type piezoelectric element 43 returns to the initial value, 10 V, and then is kept in this state.

At a point of time indicated by reference character (k) in FIG. 22, which point is later than the point of time indicated by reference character (j) in FIG. 22, as mimetically shown in FIG. 25(C), the mixed solution 69 is torn off from the discharge medium 49 to be discharged from the discharge medium nozzle 54, and further the discharge medium 49 is pulled into the discharge medium nozzle 54.

Furthermore, at a point of time indicated by reference character (l) in FIG. 22, which point is later than the point of time indicated by reference character (k) in FIG. 22, the driving voltage of the second laminated type piezoelectric element 44 returns to the initial value, 15 V. Incidentally, the period between the point of time indicated by reference character (i) in FIG. 22 and the point of time indicated by reference character (l) in FIG. 22 is 100 μs. At the point of time indicated by reference character (l) in FIG. 22, as mimetically shown in FIG. 26(A), the mixed solution 69 in a sphere continues to fly to a not shown material to be recorded, and then the mixed solution 69 adheres on the material to be recorded for performing recording.

During the period between the point of time indicated by reference character (j) in FIG. 22 and the point of time indicated by reference character (l) in FIG. 22, the quantification medium 45 is gradually plugged in the quantification medium nozzle 53 by the capillary attraction, and then at the point of time indicated by reference character (l) in FIG. 22, as mimetically shown in FIG. 26(A), the quantification medium 45 is plugged up to the tip of the quantification nozzle 53.

Furthermore, at a point of time indicated by reference character (m) in FIG. 22 later than the point of time indicated by reference character (l) in FIG. 22, as mimetically shown in FIG. 26(B), the discharge medium 49 is plugged in the discharge medium nozzle 54 by the capillary attraction similarly to the quantification medium 45, and at a later point of time indicated by reference character (n) in FIG. 22, as mimetically shown in FIG. 26(C), the discharge medium 49 returns to the waiting state thereof.

It is known that the amount of the projection of the first laminated type piezoelectric element 43 varies linearly to the driving voltage thereof. Besides, since the mixing ratio of the mixed solution is determined in accordance with the amount of the pushed out quantification medium, the reflection density of a dot is also determined under a one-to-one correspondence to the driving voltage. That is, the driving voltage is determined under the one-to-one correspondence to a desired gradation value. We here suppose that the gradation value when the quantification is done under the driving voltage of 10 V is the maximum gradation value to be 255/255, as shown in FIG. 22. Then, as the gradation value at the time of the quantification for a period of points of time indicated by reference characters (n)-(o)-(p)-(q) in FIG. 22 when the driving voltage takes a waveform of 4 V, which period follows to the period when the driving voltage takes a waveform of 10 V as shown in FIG. 22, one value of x that becomes x/255 is determined.

The characteristic of the driving system described above that the mixed solution is discharged after waiting for the quantification medium ink, which has been pushed out on the discharge medium nozzle to be quantified, to be naturally settled in the discharge medium nozzle.

That is, the driving system should perform two operations in a period, one of which is the operation of "the quantification of the quantification medium" and the other of which is the operation of "the quantification medium is settled in the discharge medium nozzle while the quantification medium is mixed with the discharge medium". In particular, in the case where a large quantity of the quantification medium is quantified at the maximum density, it is difficult to increase the driving frequency because it took a long time to settle the quantification medium in the discharge nozzle while the quantification medium is mixed with the discharge medium.

Furthermore, if the amount of ink to be quantified is increased more than a predetermined amount, the quantification medium ink overflows the discharge medium nozzle before the quantification medium ink is pulled into the discharge medium nozzle by the capillary attraction. Such overflow may bring about the change of the discharging direction by the fact that the mixed solution to be discharged is drawn by the overflowed ink, and further may result in no discharge at the worst.

For example, although the present system pushes out the quantification medium from the waiting state under 10 V driving voltage, if the driving voltage of the waiting state is tried to be increased, the quantification medium and the discharge medium are not mixed more than a predetermined mixing ratio as shown in FIG. 27. FIG. 27 shows the results of an experiment using the printer head shown in FIG. 21 and the driving voltages of the waveforms shown in FIG. 22. When the amount of the quantification of the quantification medium is increased in the case where the total consumption amount of the mixed solution is 60 pl per one drop, the operation of the head becomes unstable if the amount exceeds the boundary line shown in FIG. 27.

FIGS. 28(A)–28(C) are drawings mimetically illustrating observations of the states of the quantification medium 45 in the vicinity of the quantification medium nozzle 53 and the discharge medium nozzle 54 by means of a microscope using a stroboscope.

FIG. 28(A) shows a halfway state of the quantification of the quantification medium 45 in the vicinity of the nozzles 53 and 54 in the unstable area. The quantification medium 45 that has already quantified exists on the discharge medium nozzle 54 as if it goes to overflow, as shown in FIG. 28(A). In the unstable area in FIG. 27, the quantification medium 45 continues to be pushed out for being quantified furthermore.

As shown in FIG. 28(B), the quantification medium 45, which could not exist on the discharge medium nozzle 54 after being further pushed out, overflows around both the nozzles 53 and 54.

As shown in FIG. 28(C), the remaining quantification medium 45 shown in FIG. 28(B) pulls the mixed solution 69 to be discharged to a direction being off from the direction normal to a nozzle plate, resulting in the disturbance of the direction of discharging the mixed solution 69, not discharging and the like.

That is, the maximum quantification amount of the quantification medium 45 is the amount of the quantification medium 45 that can exist on the discharge medium nozzle 54 without overflowing in this driving system. If quantification more than the maximum quantification amount is tried, the results shown in FIGS. 28(A)–28(C) may bring about such results as are shown in FIGS. 28(A)–28(C).

Furthermore, such an operation as "accumulating the quantification medium 45 on the discharge medium nozzle 54" is strongly influenced by the treatment of the surface of the discharge medium nozzle 54 such as a water repellent treatment. If the effect of the water repellent treatment is strong, the amount of the quantification medium 45 capable of being accumulated or being quantified becomes great in quantity. If the water repellent treatment is not done, the quantification medium 45 becomes easy to overflow because the periphery of the discharge medium nozzle 54 is easy to be wetted, resulting that the amount of the quantification medium 45 capable of being accumulated increases. Furthermore, the force of repelling water is easy to produce differences between each channel because of the wear caused by cleaning operations of the head and the deterioration by aging. Namely, the force of repelling water is easy to be influenced by the variation of the state of the water repellent treatment, and the differences between each nozzle are large at the highest gradation value.

SUMMARY OF THE INVENTION

Accordingly, the present invention aims at solving the aforementioned problems to provide a printer head, an ink jet printer and a method for driving a printer head capable of improving the mixing ratio of the quantification medium to the discharge medium, and capable of realizing the desired maximum density by making a high density mixed solution for a short time, and then capable of increasing unnecessary mixtures of colors.

According to a first aspect of the present invention, there is provided a printer head in an ink jet printer, comprises: a quantification medium pressuring chamber where a quantification medium is introduced; a discharge medium pressuring chamber where a discharge medium is introduced; a quantification medium nozzle communicating with the quantification medium pressuring chamber; a discharge medium nozzle communicating with the discharge medium pressuring chamber, the discharge medium nozzle being disposed to adjoin the quantification medium nozzle; and a first pressure generating element pulling the quantification medium pushed out of the quantification medium nozzle into the discharge medium nozzle to form a mixed solution by contacting the quantification medium in the discharge medium nozzle through a surface where the quantification medium nozzle opens, wherein the first pressure generating element then generates a pressure for discharging the mixed solution from the discharge medium nozzle.

According to the first aspect of the invention, since the quantification medium pushed out of the quantification medium nozzle is once pulled into the discharge medium nozzle forcibly, and then the mixed solution of the quantification medium and the discharge medium is discharged, the mixing ratio of the quantification medium and the discharge medium can be enhanced to enable the quantification of a great deal of quantification medium for a period. Furthermore, it is possible to make the mixed solution by mixing a great deal of quantification medium with the discharge medium for a short time.

According to a second aspect of the invention, there is provided an ink jet printer equipped with a printer head, wherein the printer head comprises: a quantification medium pressuring chamber where a quantification medium is introduced; a discharge medium pressuring chamber where a discharge medium is introduced; a quantification medium nozzle communicating with the quantification medium pressuring chamber; a discharge medium nozzle communicating with the discharge medium pressuring chamber; the discharge medium nozzle being disposed to adjoin the quantification medium nozzle; and a first pressure generating element pulling the quantification medium pushed out of the quantification medium nozzle into the discharge medium nozzle to form a mixed solution by contacting said quantification medium in the discharge medium nozzle through a surface where the quantification medium nozzle opens, wherein the first pressure generating element then generates a pressure for discharging the mixed solution from the discharge medium nozzle.

According to the second aspect of the invention, there can be obtained advantages similar to those of the first aspect of the invention.

According to a third aspect of the invention, there is provided a method for driving a printer head, the method comprises the steps of: moving a quantification medium pushed out of a quantification medium nozzle from the quantification medium nozzle to a discharge medium nozzle through a surface where the quantification medium nozzle opens; forming a mixed solution by pulling the quantification medium into the discharge medium nozzle to contact with the discharge medium in the discharge medium nozzle; and discharging the mixed solution from the discharge medium nozzle.

According to the third aspect of the invention, there can be obtained advantages similar to those of the first aspect of the invention.

BRIEF DESCRIPTION OF THE DRAWINGS

The above and other objects, features and advantages of the present invention will become more apparent from the following description of the presently preferred exemplary embodiments of the invention taken in conjunction with the accompanying drawings, in which.

DESCRIPTION OF THE PREFERRED EMBODIMENTS

Hereinafter, preferred embodiments of the present invention will be described in detail on the attached drawings.

Now, the drawings are referred while a printer head and an ink jet printer, each is an embodiment of the present invention, will be described in detail.

In this specification, the so-called carrier jet type printer that uses ink as the quantification medium and uses diluent as the discharge medium will be described.

Figure 1:
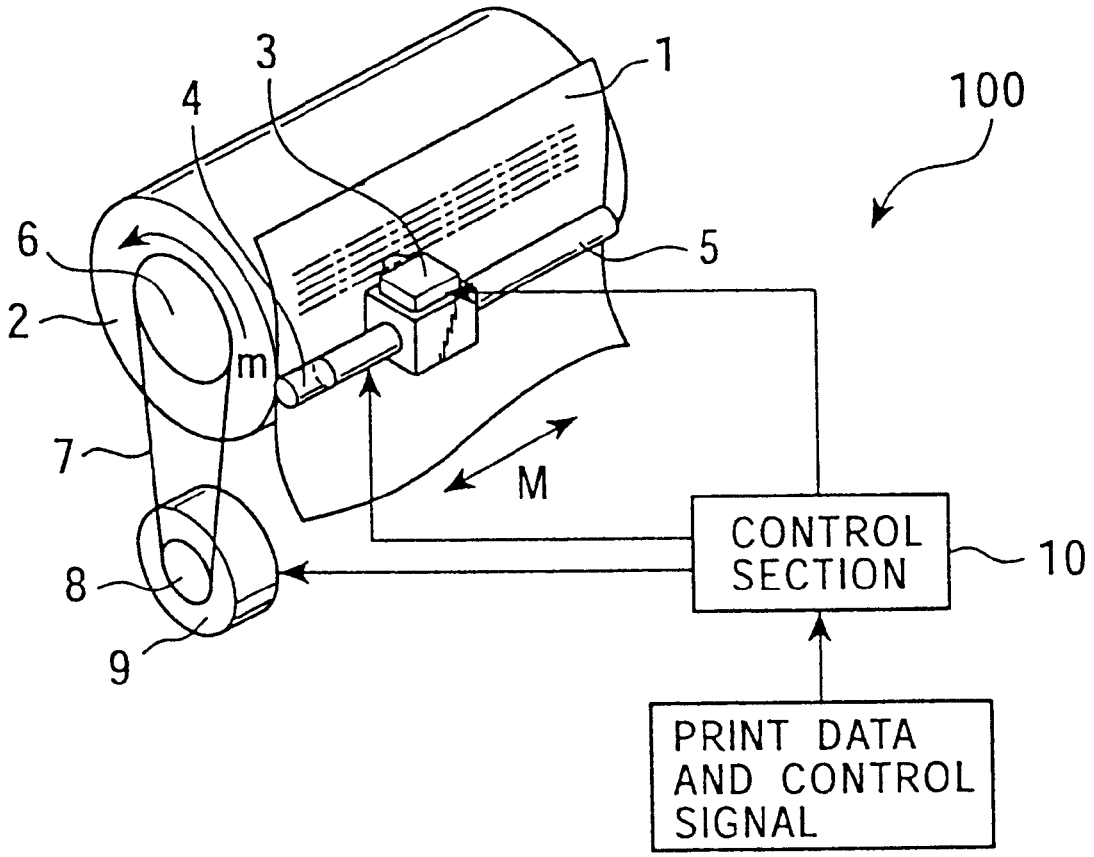
FIG. 1 is a perspective view showing an ink jet printer provided with a printer head of an embodiment according to the present invention.

An ink jet printer 100 is the so-called serial type printer, and, as shown in FIG. 1, the printer 100 is mainly composed of a drum 2 for supporting a sheet of print paper 1 to be printed, and a printer head 3 for printing on the printer paper 1.

The print paper 1 is held by being pressed to the drum 2 by a paper pressing roller 4 disposed parallel to the axial direction of the drum 2. Besides, a feed screw 5 is disposed parallel to the axial direction of the drum 2 in the vicinity of the outer periphery of the drum 2. The printer head 3 is held around the feed screw 5. The printer head 3 is driven to move along the axial direction of the drum 2 indicated by an arrow M in FIG. 1 by the rotation of the feed screw 5.

On the other hand, the drum 2 is driven to rotate in the direction indicated by an arrow m in FIG. 1 by a motor 9 through a pulley 6, a belt 7 and a pulley 8. Moreover, the rotations of the feed screw 5 and the motor 9, and the printer head 3 are driven to be controlled on printing data and control signals by a control section 10 for head-driving, the control of head-feeding and the control of drum-rotating.

With the aforementioned structure, when the printer head 3 moves and has completes printing of a line, the drum 2 is rotated by a line for the following print. In case of printing a picture, the printer head 3 moves to only one direction or to back and forth directions.

Figure 2:
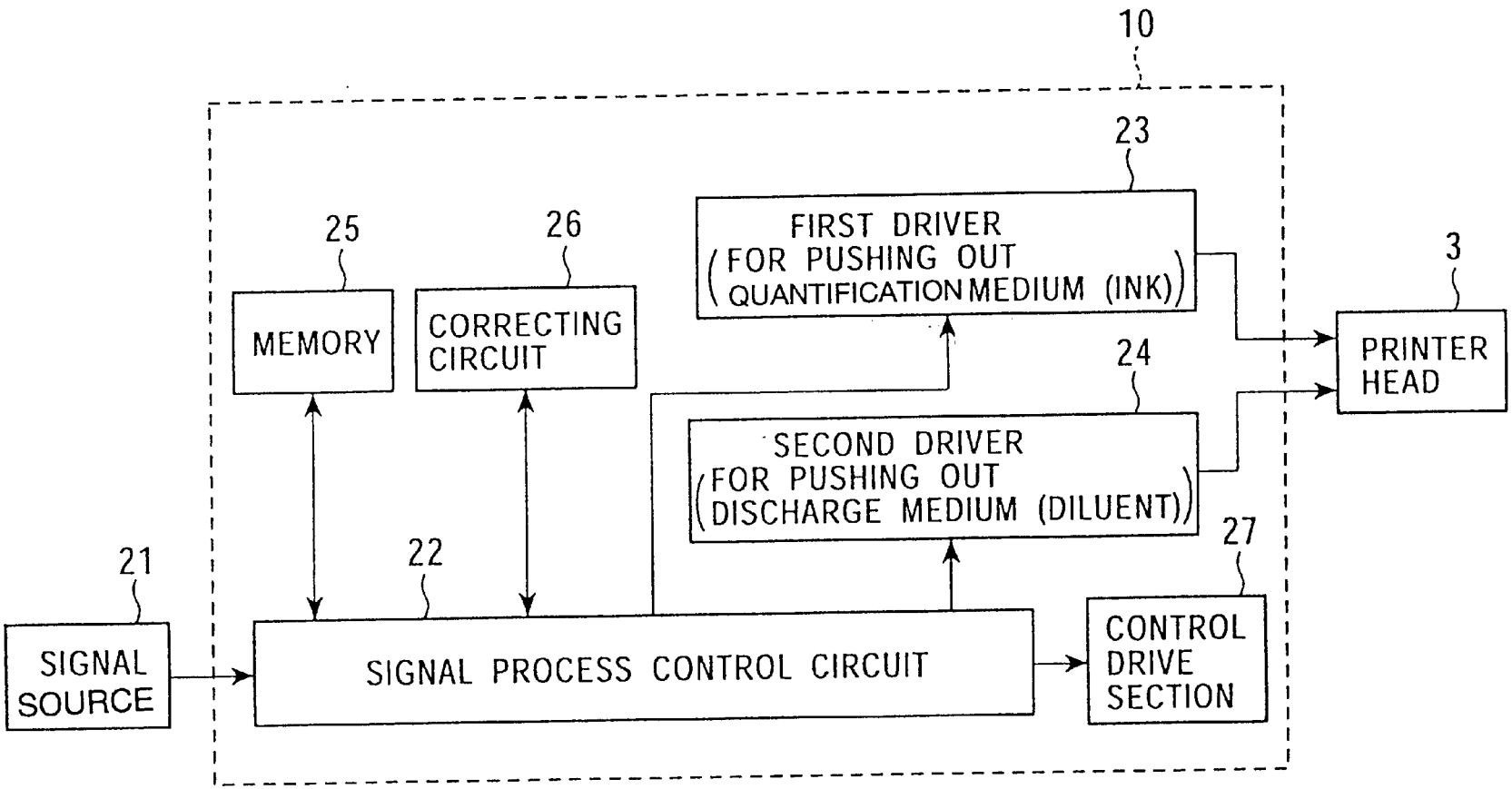
FIG. 2 is a block diagram showing a printing and controlling system of the ink jet printer of FIG. 1.

FIG. 2 is a block diagram showing a printing and controlling system of the ink jet printer 100. The ink jet printer 100 is controlled by the control section 10 shown in FIG. 2. The control section 10 is composed of a signal process control circuit 22, a first driver 23, a second driver 24, a memory 25, a correcting circuit 26 and a control drive section 27. The signal process control circuit 22 is composed of a central processing unit (CPU) or a digital signal processor (DSP).

Those first driver 23 and second driver 24 are equipped in accordance with the number of the quantification medium nozzles and the discharge medium nozzles, respectively. The first driver 23 drives a first laminated type piezoelectric element for controlling it, which element to be described later is a first pressure imposing means equipped for pushing the quantification medium out of the quantification medium nozzle.

The second driver 24 drives a second laminated type piezoelectric element for controlling it, which element to be described later is a second pressure imposing means equipped for discharging the discharge medium out of the discharge medium nozzle. Incidentally, either of the aforementioned quantification side or the discharge side is ink, and the other is diluent.

Each of the first driver 23 and the second driver 24 drives the first and second pressure imposing means respectively corresponding to the first and the second driver 23 and 24 on the control of a serial-parallel conversion circuit and a timing control circuit, both of which will be described later and are equipped in the signal process control circuit 22.

And further, a signal source 21 supplies such as printing data, an operation section signal and an external control signal into the signal process control circuit 22 in the control section 10 to be stored in the signal process control circuit 22 in the order of printing. The stored signals are outputted to the printer head 3 through the first and second drivers 23 and 24 to drive the printer head 3 for controlling it. The order of printing differs in accordance with structures of the printer head 3 and a printing section, and further relates to the order of inputting the printing data, too. The signals to be stored are once re-recorded in a memory 25 such as a line buffer memory or one picture memory as occasion demands, and then are read out from the memory 25.

Incidentally, in the case where there are great numbers of nozzles used in a multi-head, for example, an integrated circuit (IC) is equipped in the printer head 3 to decrease the number of wires to be connected to the printer head 3. In addition, the correcting circuit 26 is connected to the signal process control circuit 22 for performing γ-correction, color correction in case of a colored picture, correction of differences among respective heads, and the like. Correction data selected in advance are generally memorized in a read only memory (ROM) in the correcting circuit 26 into a map format to be taken out in accordance with external conditions such as a nozzle number, temperature and input signals.

The signal process control circuit 22 is generally composed of a CPU or a DSP as stated above to operate in conformity with software. A signal processed by the signal process control circuit 22 is sent to the control drive section 27. The control drive section 27 executes such operations as driving the motor 9 that drives the drum 2 and the feed screw 5 to rotate, synchronization, cleaning the printer head 3, supplying a sheet of print paper and ejecting the paper. In addition, it goes without saying that the signals supplied from the signal source 21 include an operation signal or an external signal other than the printing data.

Figure 3:
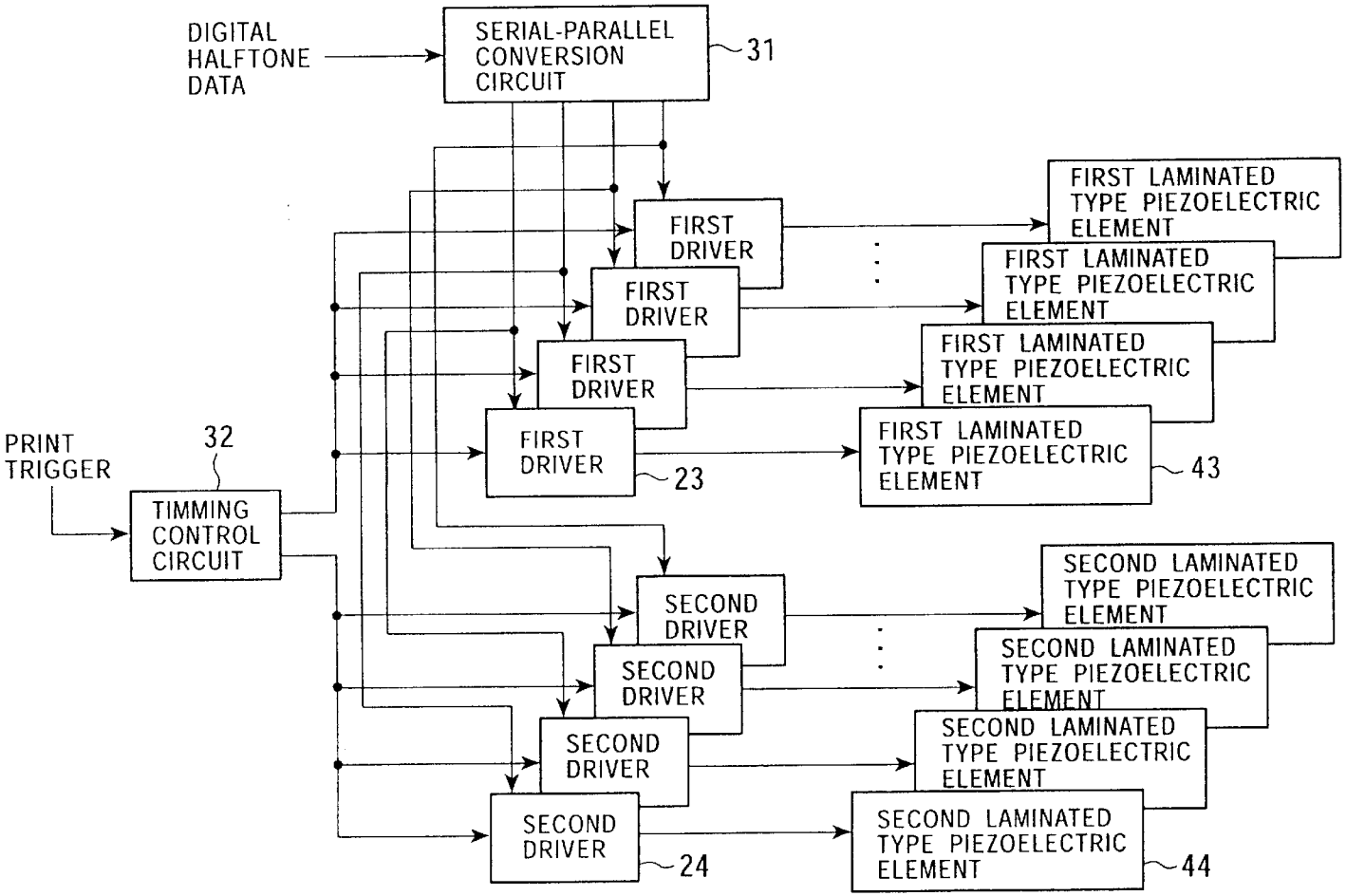
FIG. 3 is a block diagram showing a driving circuit of the printer head shown in FIG. 1.

Next, an example of a driving circuit of the aforesaid printer head is shown in FIG. 3. Digital halftone data are supplied to a serial-parallel conversion circuit 31 from another block, and then are sent to the first driver 23 and the second driver 24 from the serial-parallel conversion circuit 31. The first driver 23 is connected to the first laminated type piezoelectric element 43, and the second driver 24 is connected to the second laminated type piezoelectric element 44. The first and second drivers 23 and 24 do not execute their quantification operation and discharge operation, respectively, when the digital halftone data supplied from the serial-parallel conversion circuit 31 is a predetermined threshold value or below. When it becomes a printing timing, a print trigger is issued from another block to be detected by the timing control circuit 32. Then the timing control circuit 32 outputs a quantification section control signal and a discharge control signal to the first driver 23 and the second driver 24, respectively.

Next, the description will be done about the printer head 3 in the ink jet printer 100.

Figure 4:
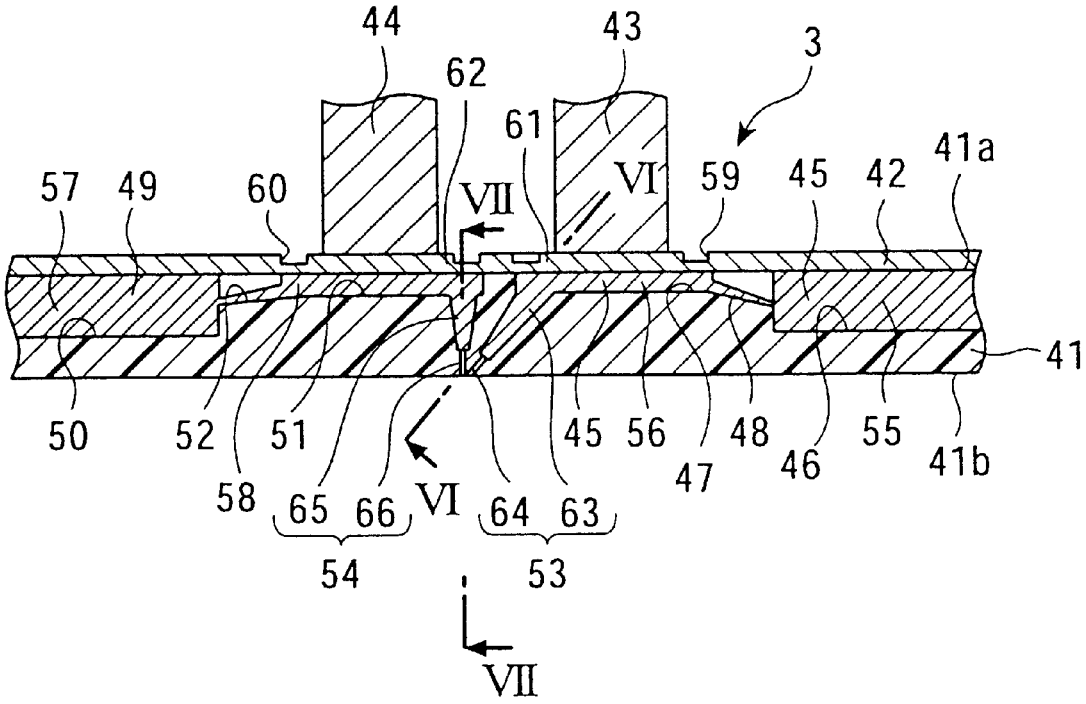
FIG. 4 is a sectional view showing the printer head shown in FIG. 1.

The printer head 3, as shown in FIG. 4, is mainly composed of a nozzle plate 41, the diaphragm 42, the first laminated type piezoelectric element 43 and the second laminated type piezoelectric element 44.

The nozzle plate 41 is made from a resin. A first concave portion 46 forming a quantification medium liquid chamber where the quantification medium 45, e.g. ink, is supplied and a second concave portion 47 forming a quantification medium pressing chamber where the aforesaid quantification medium 45 is plugged are formed in the nozzle plate 41 so that the first and second concave portions 46 and 47 are open to a surface 41*a* on the diaphragm 42 side. A first supplying passage 48 connects a side face of the first concave portion 46 and a side face of the second concave portion 47 opposite to the side face of the first concave portion 46 to be formed as a through-hole substantially parallel to the surface 41*a*.

Furthermore, a third concave portion 50 forming a discharge medium liquid chamber for, e.g. a diluent, and a fourth concave portion 51 forming a discharge medium pressuring chamber where a aforesaid discharge medium 49 is plugged are formed to be open to the surface 41*a* on the diaphragm 42 side. A second supplying passage 52 connects a side face of the third concave portion 50 and a side face of the fourth concave portion 51 opposed to the side face of the third concave portion 50 to be formed as a through-hole substantially parallel to the surface 41*a*.

Furthermore, in the nozzle plate 41, the quantification medium nozzle 53 is formed as a through-hole formed in an oblique direction to the thickness direction of the nozzle plate 41 from the bottom face side of the second concave portion 47 to a surface 41*b* on the opposite side of the diaphragm 42, and similarly the discharge medium nozzle 54 is formed as a through-hole formed in the thickness direction of the nozzle plate 41 from the bottom face side of the fourth concave portion 51 to the surface 41*b* on the opposite side of the diaphragm 42.

Figure 5:
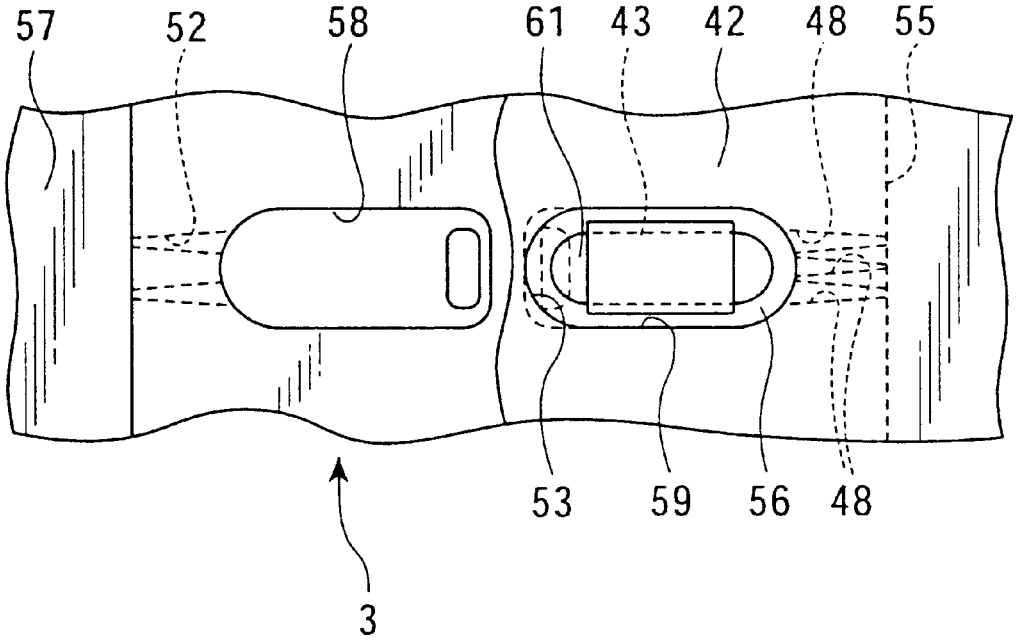
FIG. 5 is a plan view showing the printer head shown in FIG. 1.

By disposing the diaphragm 42 so as to cover the aforesaid each concave portion, a space formed between the first concave portion 46 and the diaphragm 42 is shaped as a quantification medium liquid chamber 55, and a space formed between the second concave portion 47 and the diaphragm 42 is shaped as a quantification medium pressuring chamber 56, and then, as also shown in FIG. 5, the quantification medium liquid chamber 55, the first supplying passage 48, the quantification medium pressuring chamber 56 and the quantification medium nozzle 53 are formed as a continuous space.

A space formed between the third concave portion 51 and the diaphragm 42 as a discharge medium liquid chamber 57, and a space formed between the fourth concave portion 51 and the diaphragm 42 is shaped as a discharge medium pressuring chamber 58, and then, as also shown in FIG. 5, the discharge medium liquid chamber 57, the second supplying passage 52, the discharge medium pressuring chamber 58 and the discharge medium nozzle 54 are formed as a continuous space.

FIG. 5 is a plan view showing a state that the first piezoelectric element 43 is disposed on the quantification side. FIG. 5 also shows plan view when the nozzle plate 41 is observed from the surface 41*a* side on the discharge side.

Incidentally, as shown in FIG. 4, an annular concave portion 59 is formed on the top surface of the diaphragm 42 at a position corresponding to the outer periphery portion of the quantification medium pressuring chamber 56, and also an annular concave portion 60 is formed on the top surface of the diaphragm 42 at a position corresponding to the outer periphery portion of the discharge medium pressuring chamber 58. Consequently, when the diaphragm 42 is overlooked from the upper side, as shown on the quantification side of FIG. 5, a projecting portion 61 is formed at a position corresponding to the quantification medium pressuring chamber 56 and the first laminated type piezoelectric element 43 is disposed on the projecting portion 61. This situation is similar in the discharge side. That is, as shown in FIG. 4, a projecting portion 62 is formed inside the surrounding concave portion 60, and the second laminated type piezoelectric element 44 is disposed on the projecting portion 62.

In the printer head 3, the quantification medium nozzle 53 is formed in the oblique direction to the thickness direction of the nozzle plate 41 as described above, and the discharge medium nozzle 54 is formed in the thickness direction of the nozzle plate 41. Consequently, the printer head 3 is constructed so that the nearer a position in the thickness direction of the nozzle plate 41 becomes to the surface 41*b* where the nozzles 53 and 54 open, the nearer the quantification medium nozzle 53 approaches to the discharge medium nozzle 54.

On the surface 41*b* where the nozzles 53 and 54 are open, the openings of the nozzles 53 and 54 adjoin. Incidentally, an angle formed by the central lines of the quantification medium nozzle 53 and the discharge medium nozzle 54 is set as for example 30°.

Figure 6:
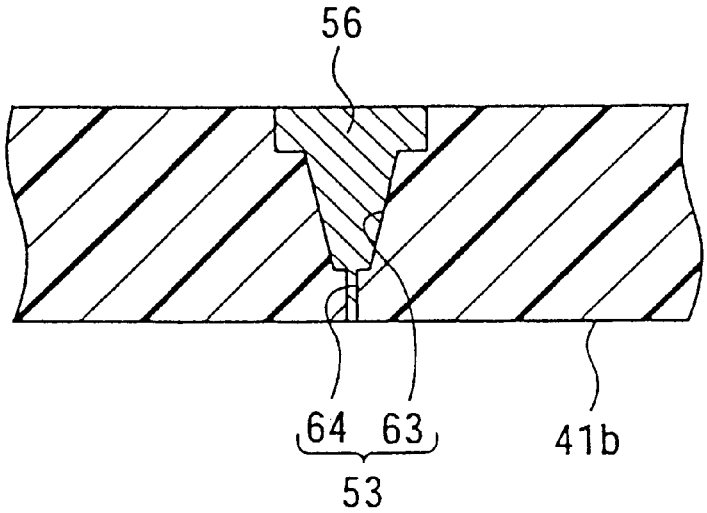
FIG. 6 is a sectional view along VI—VI line of FIG. 4 showing the vicinity of the quantification medium nozzle in the printer head shown in FIG. 1.

Incidentally, as also shown in FIG. 6, which is a sectional view of the quantification medium nozzle 53 sectioned along the VI—VI line in FIG. 4, the quantification medium nozzle 53 is comprised of a first tapered nozzle portion 63 where both inside walls thereof are formed to have a taper so that the width between both the walls becomes narrower as a position in the thickness direction of the nozzle plate 41 approaches to the surface 41*b* from the bottom face of the quantification medium pressuring chamber 56, and a first nozzle portion 64 formed continuously to the tip of the first tapered nozzle portion 63 as a practical nozzle.

Figure 7:
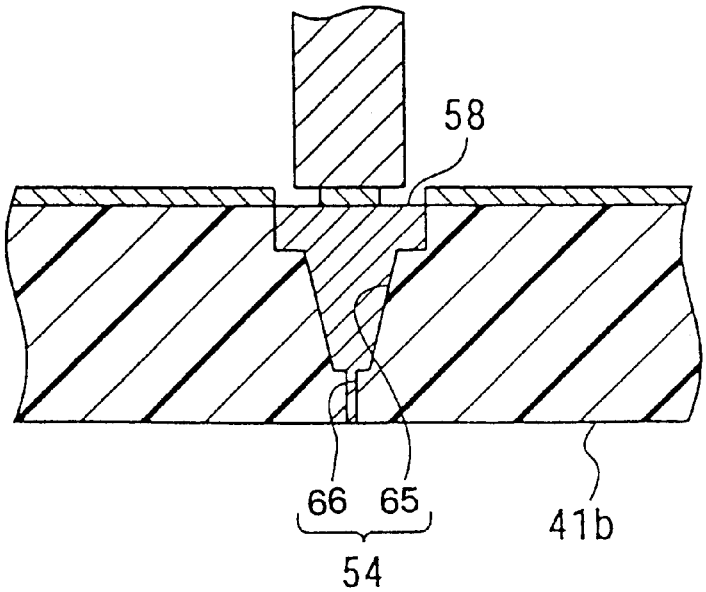
FIG. 7 is a sectional view along VII—VII line of FIG. 4 showing the vicinity of the discharge medium nozzle in the printer head shown in FIG. 1.

Furthermore, as also shown in FIG. 7, which is a sectional view of the discharge medium nozzle 54 sectioned along the VII—VII line in FIG. 4, the discharge medium nozzle 54 is comprised of a second tapered nozzle portion 65 where both inside walls thereof are formed to have a taper so that the width between both the walls becomes narrower as a position in the thickness direction of the nozzle plate 41 approaches to the surface 41*b* from the bottom face of the discharge medium pressuring chamber 58, and a second nozzle portion 66 formed continuously to the tip of the second tapered nozzle portion 65 as a practical nozzle.

By forming the first tapered nozzle portion 63 and the second tapered nozzle portion 65 like this, the flow path resistances of the quantification medium nozzle 53 and the discharge medium nozzle 54 decrease. Consequently, the smooth flow of the liquid can be realized, and in particular, the effect of preventing air bubbles from remaining in the nozzles when ink and diluent is first plugged therein.

In FIG. 4, the quantification medium 45, e.g. ink, is plugged in the quantification medium nozzle 53 from a quantification medium tank, not shown, through the quantification medium liquid chamber 55, the first supplying passage 48 and the quantification medium pressuring chamber 56.

On the other hand, the discharge medium 49, i.e. diluent, is plugged in the discharge medium nozzle 54 from a discharge medium tank, not shown, through the discharge medium liquid chamber 57, the second supplying passage 52 and the discharge medium pressuring chamber 58.

Water repellent finishing is formed on the surface 41*b* of the nozzle plate 41 where the nozzles 53 and 54 of the printer head 3 open for preventing the ink and the diluent around the nozzles 53 and 54 from wetting to enhance the stability of discharging the liquid droplets and the accuracy of the discharging direction.

In the printer head 3, in particular, the shape of the opening of the quantification medium nozzle 53 is formed as a shape including a notch on the side of the discharge medium nozzle 54.

In other words, the shape of the opening of the quantification medium nozzle 53 is formed so that the minimum distance between the center of an inscribed circle contacting the opening of the quantification medium nozzle 53 and the edge of the opening of the discharge medium nozzle 54 is larger than the minimum distance between the center of a circumscribed circle contacting the opening of the quantification medium nozzle 53 and the edge of the opening of the discharge medium nozzle 54.

Figure 8:
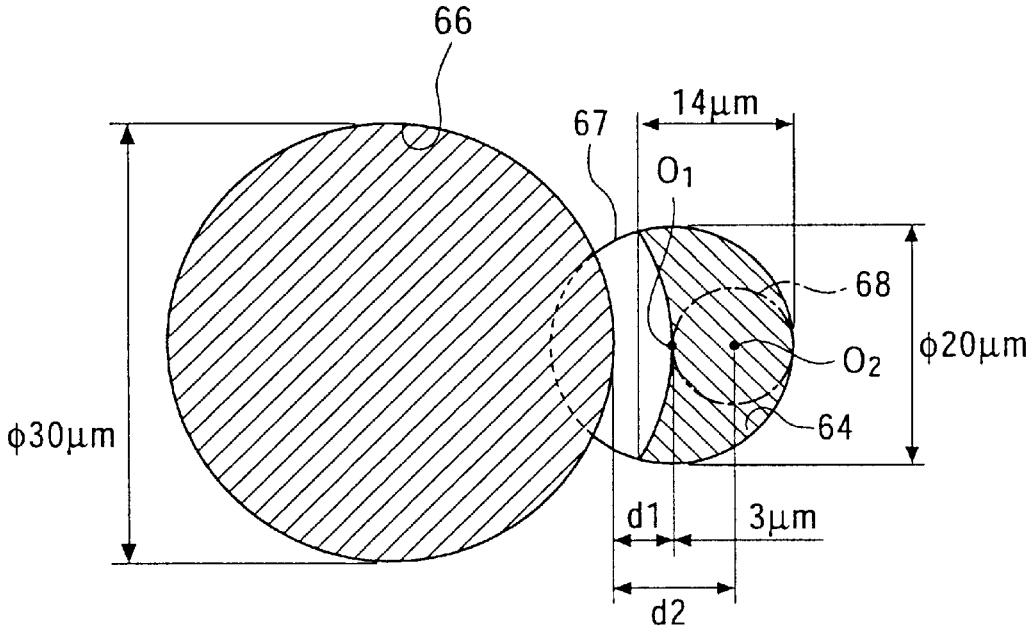
FIG. 8 is a plan view showing the vicinity of the nozzles in the printer head shown in FIG. 1.

Now, as shown in FIG. 8, it is supposed that the shape of the opening of the second nozzle portion 66 of the discharge medium nozzle 54 is a circle, and that the shape of the opening of the first nozzle portion 64 of the discharge medium nozzle 53 is a partially eclipsed shape. In such a shape, the minimum distance d2 between the center O2 of an inscribed circle 68 shown by a broken line in FIG. 8, which circle 68 contacts with an opening of the first nozzle 53, and the opening of the discharge medium nozzle 54 is larger than the minimum distance d1 between the center O1 of a circumscribed circle 67 shown by an alternate dot and dashed line in FIG. 8, which circle 67 contacts with an opening of the first nozzle portion 64, i.e. the opening of the quantification medium nozzle 53, and the opening of the discharge medium nozzle 54.

Figure 9:
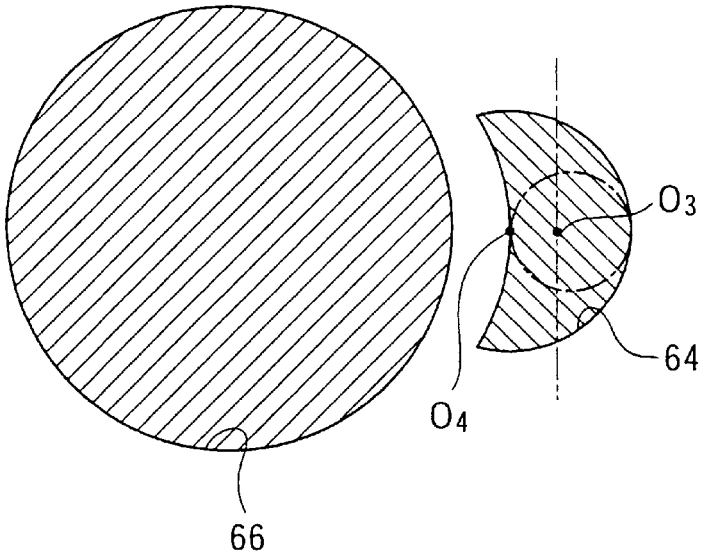
FIG. 9 is another plan view showing the vicinity of the nozzles in the printer head shown in FIG. 1.

As shown in FIG. 9, since the shape of the opening of the first nozzle portion 64 of the quantification medium nozzle 53 is assumed to be a partially eclipsed shape, in such a shape, an edge O4 of an opening nearest to the center O3 of the shape of the opening of the first nozzle portion 64, i.e. the opening of the quantification medium nozzle 53, is on the side of the second nozzle 66, i.e. the opening of the discharge medium nozzle 54.

In FIGS. 8 and 9, only one couple of the couples of the quantification medium nozzle 53 and the discharge medium nozzle 54 is shown, however, a plurality of the couples, e.g. 32 couples, are equipped in the present invention. Those quantification medium nozzles 53 and the discharge medium nozzles 54 are disposed so that a quantification medium nozzle 53 of one couple adjoins another quantification medium nozzle 53 of another couple, and a discharge medium nozzle 54 of one couple adjoins another discharge medium nozzle of another couple.

FIGS. 11(A)–13(C) show mimetically an example of a method for driving a quantification medium and the discharge medium by the printer head 3 in the ink jet printer of the present embodiment.

Figure 11A:
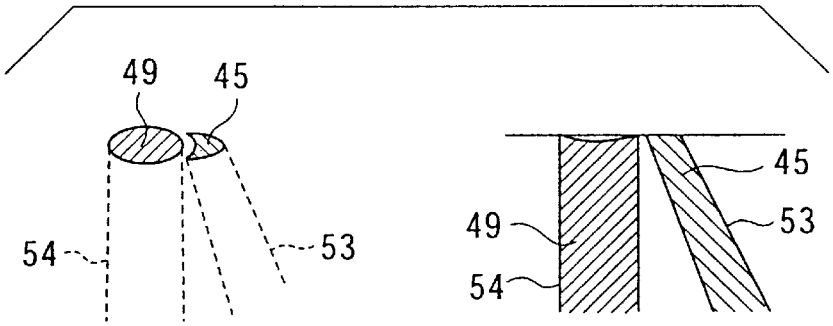
FIGS. 11(A)–11(C) are mimetic views showing a state of waiting, a state of discharging the quantification medium and a state of coupling of the quantification medium and the discharge medium in the printer head shown in FIG. 1, respectively.

FIG. 11(A) shows a waiting state, in which the surfaces of the quantification medium 45 and the discharge medium 49 form a little bit concave meniscus by a negative static pressure owing to an ink supplying system, not shown.

Figure 11B:
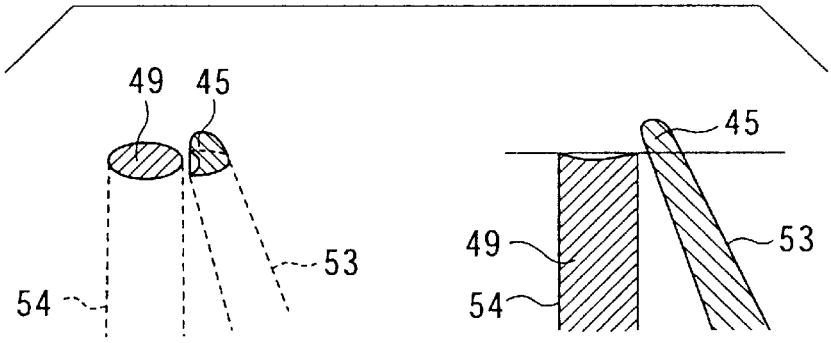

In the state shown in FIG. 11(B), the quantification medium 45 begins to be pushed out of the quantification medium nozzle 53.

Figure 11C:
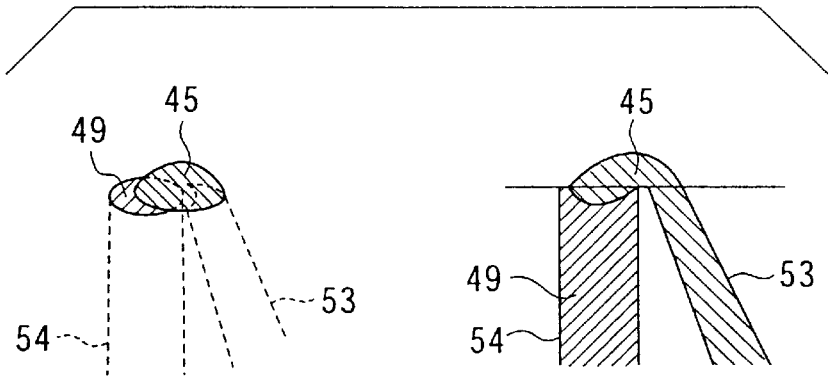

The pushed out quantification medium 45 shown in FIG. 11(C) overflows on the discharge medium nozzle 54 owing to the obliquity of the quantification medium nozzle 53 to the discharge medium nozzle 54 and the effect of the crescent shape of the quantification medium nozzle 53, i.e. a force impelling the quantification medium to be a sphere due to the surface tension. The overflowed quantification medium 45 contacts with the discharge medium 49 to be combined with the discharge medium 49 owing to the surface tension.

Figure 12A:
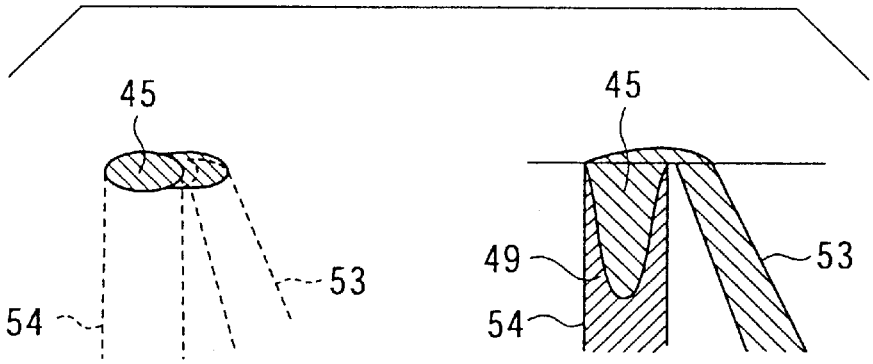
FIGS. 12(A)–12(C) are mimetic views showing a state of pulling the discharge medium into the discharge medium nozzle, a state of completing pushing the quantification medium out of the quantification medium nozzle and a state of beginning to pull the quantification medium into the discharge medium nozzle in the printer head shown in FIG. 1, respectively.

FIG. 12(A) shows a state that the discharge medium 49 is drawn into the discharge medium nozzle 54. The quantification medium 45 existing on the discharge medium nozzle 49 and the successively pushed out quantification medium 45 are also forced to be drawn into the discharge medium nozzle 54 together with the discharge medium 49.

Figure 12B:
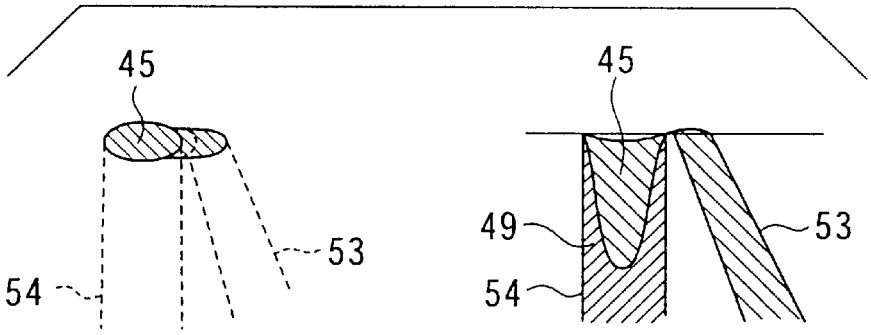

In the state shown in FIG. 12(B), the pushing out of the quantification medium 45 is completed.

Figure 12C:
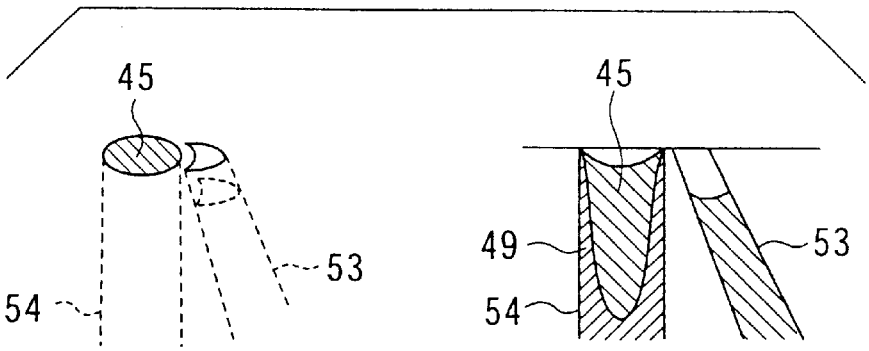

In the state shown in FIG. 12(C), the quantification medium 45 begins to be pulled into the discharge medium nozzle 54. By the pulling of the quantification medium 45 into the discharge medium nozzle 54, the discharge medium 49 and the quantification medium 45 is separated and the meniscus of the quantification 45 recedes into the quantification medium nozzle 53. The meniscus of the discharge medium 49 also continues being pulled into the discharge medium nozzle 54.

Figure 13A:
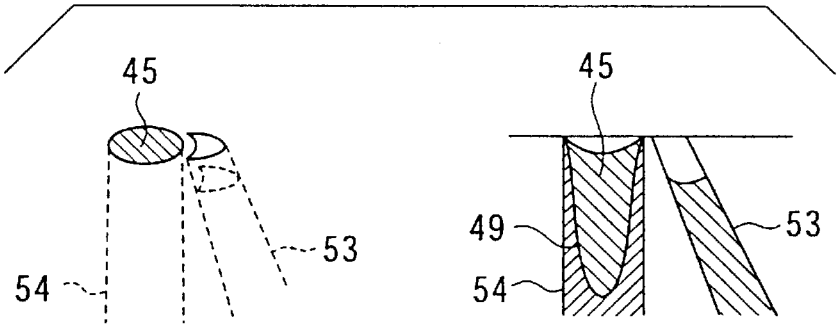
FIGS. 13(A)–13(C) are mimetic views showing a state of completing to pull the quantification medium and the discharge medium into the discharge medium nozzle, a state of discharging the discharge medium from the discharge medium nozzle and a state of waiting in the printer head shown in FIG. 1, respectively.

FIG. 13(A) shows a state that the pulls of the quantification medium 45 and the discharge medium 49 into the discharge medium nozzle 54 are completed.

Figure 13B:
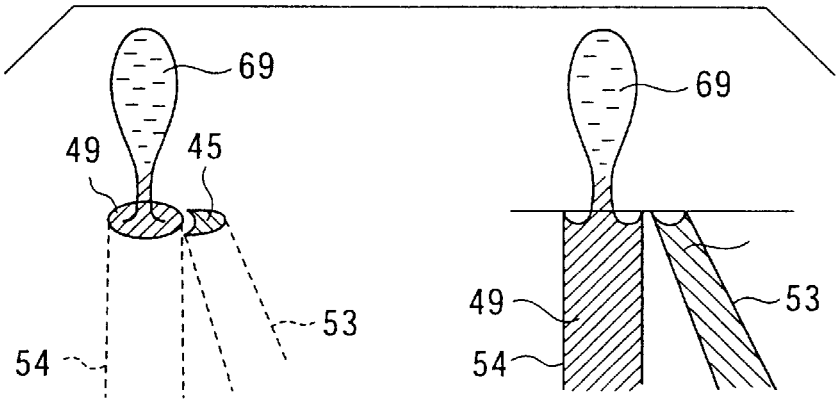

FIG. 13(B) shows a state that the discharge medium 49 is discharged. The mixed solution 69, which is a mixture of the quantification medium 45 and the discharge medium 49 that were mixed together on the tip of the discharge medium nozzle 54, is discharged from the discharge medium nozzle 54.

Figure 13C:
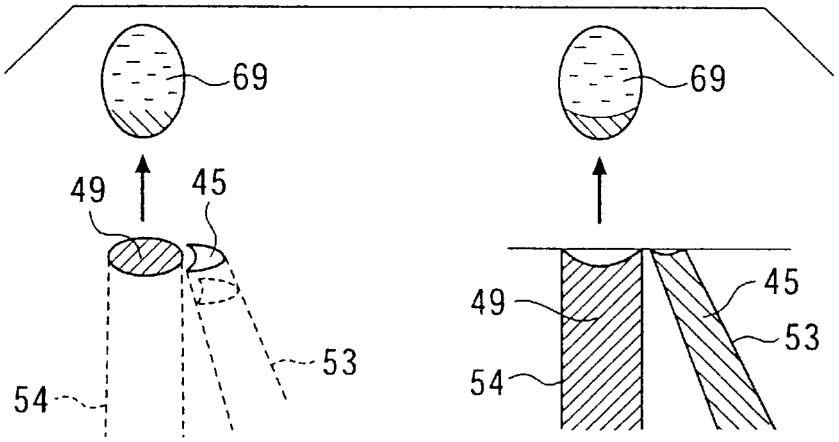

In a state shown in FIG. 13(C), the vibration of the meniscus after being discharged decreases to return to the state of waiting.

Figure 10:
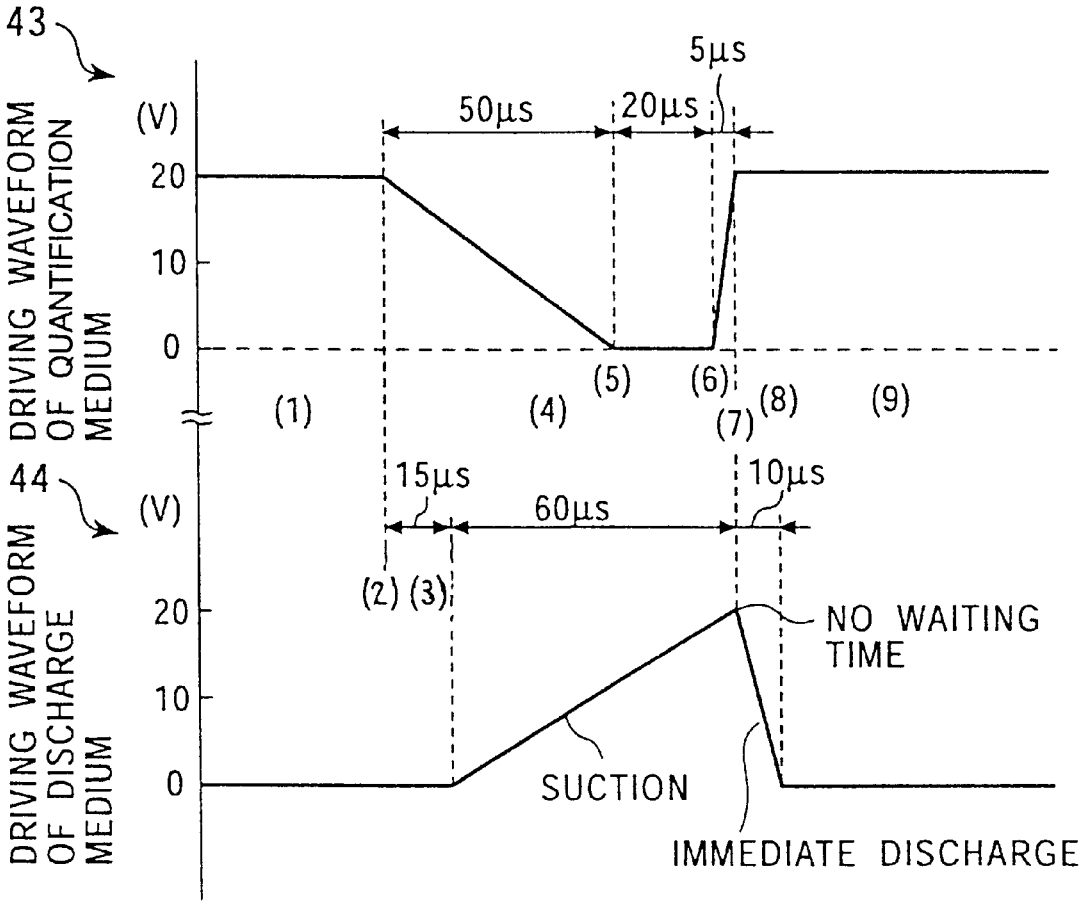
FIG. 10 is a diagram showing a driving waveform of the qualification medium and a driving waveform of the discharge medium by the driving circuit of FIG. 3.

Driving waveforms of the piezoelectric elements (PZT) for performing the aforesaid driving are shown in FIG. 10. FIG. 10 and FIGS. 11(A)–13(C) will be referred while the states of driving the quantification medium 45 and the discharge medium 49 will be described.

(1) A positive voltage, e.g. 20 V in the present embodiment, is previously imposed on the first piezoelectric element 43 on the quantification side in a waiting state (see FIG. 11(A)), and the first piezoelectric element 43 is in a state of being shrunken in the displacement direction, i.e. in the direction perpendicular to the diaphragm 42. Namely, the volume of the quantification medium pressuring chamber 56 is in a state of being swollen. On the second piezoelectric element 41 there is no voltage imposed, and the second piezoelectric element is in its initial state.

(2) The voltage imposed on the first piezoelectric element 43 begins to decrease. The internal pressure of the quantification medium pressuring chamber 56 begins to increase to start the pressuring of the quantification medium 45 (see FIG. 11(B)).

(3) The quantification medium 45 is pushed out on the discharge medium nozzle 53 to contact with the discharge medium 49, and then they are combined together by the surface tension (see FIG. 11(C)).

(4) The voltage of the second piezoelectric element 44 on the discharge side is gradually being increased. The second piezoelectric element 44 on the discharge side begins to shrink, and the discharge medium pressuring chamber 58 begins to swell. The internal pressure of the discharge medium pressuring chamber 58 decreases, and then the discharge medium 49 and the quantified quantification medium 45 is pulled into the discharge medium nozzle 54 (see FIG. 12(A)).

(5) The lowering of the voltage imposed on the first piezoelectric element 43 on the quantification side is completed (see FIG. 12(B)).

(6) By imposing again on the first piezoelectric element 43 on the quantification side, the piezoelectric element is made to be shrunken and the volume of the quantification medium pressuring chamber 56 is made to be swollen. The internal pressure of the quantification medium pressuring chamber 56 is lowered, and then the quantification medium 45 is pulled into the quantification medium nozzle 53. The quantification medium 45 and the discharge medium 49 is separated (see FIG. 12(C)).

(7) The rising of the voltages imposed on the second piezoelectric element 44 on the discharge side and the first piezoelectric element 43 on the quantification side is completed. The pulling of the discharge medium 49 and the quantification medium 45 into the nozzles 53 and 54 is completed (see FIG. 13(A)).

(8) By lowering the voltage imposed on the second piezoelectric element 44 on the discharge side, the second piezoelectric element 44 is made to be elongated, and the volume of the discharge medium pressuring chamber 58 is made to be shrunken. The internal pressure of the discharge medium pressuring chamber 58 rises to discharge the mixed solution 69 (see FIG. 13(B)).

(9) The voltages imposed on both the first and second piezoelectric elements 43 and 44 return to the initial values, respectively. The vibration of the meniscus decreases to return to the initial state (see FIG. 13(C)).

By driving the first and second piezoelectric elements 43 and 44 as mentioned above, the quantification medium 45 pushed out on the discharge medium nozzle 54 does not overflow around the discharge medium nozzle 54 to be pulled into the discharge medium nozzle 54, and then the more amount of the quantification medium 45 can be quantified.

Figure 18:
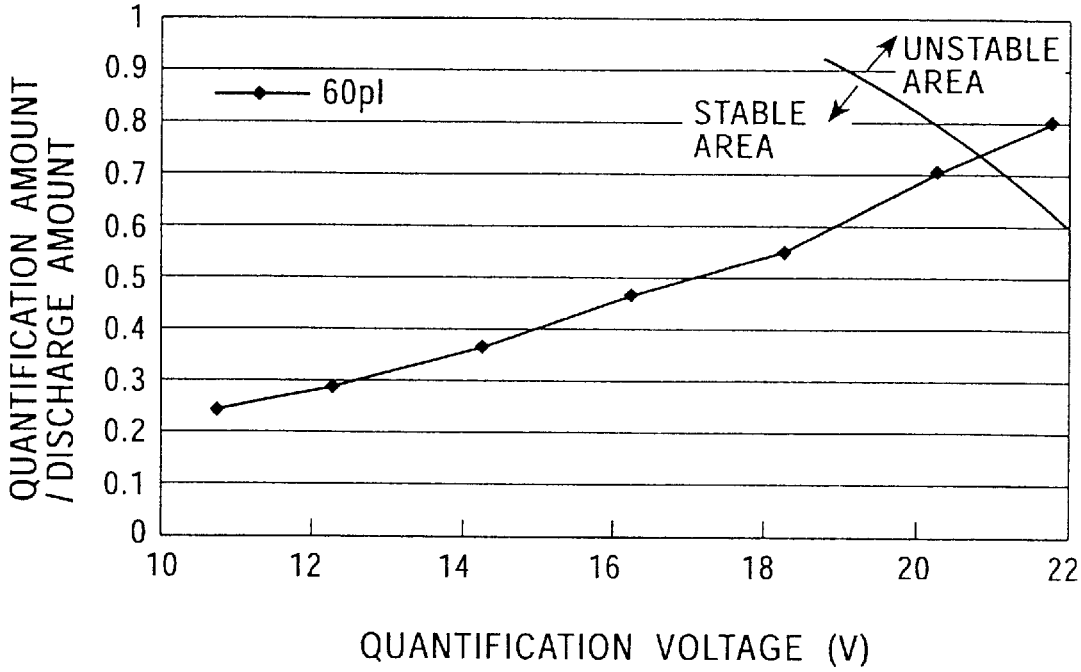
FIG. 18 is a chart illustrating results of an experiment according to the driving method of an embodiment of the present invention, showing mixing ratios of the quantification medium to the discharge medium according to the driving voltage of the quantification medium.
Figure 27:
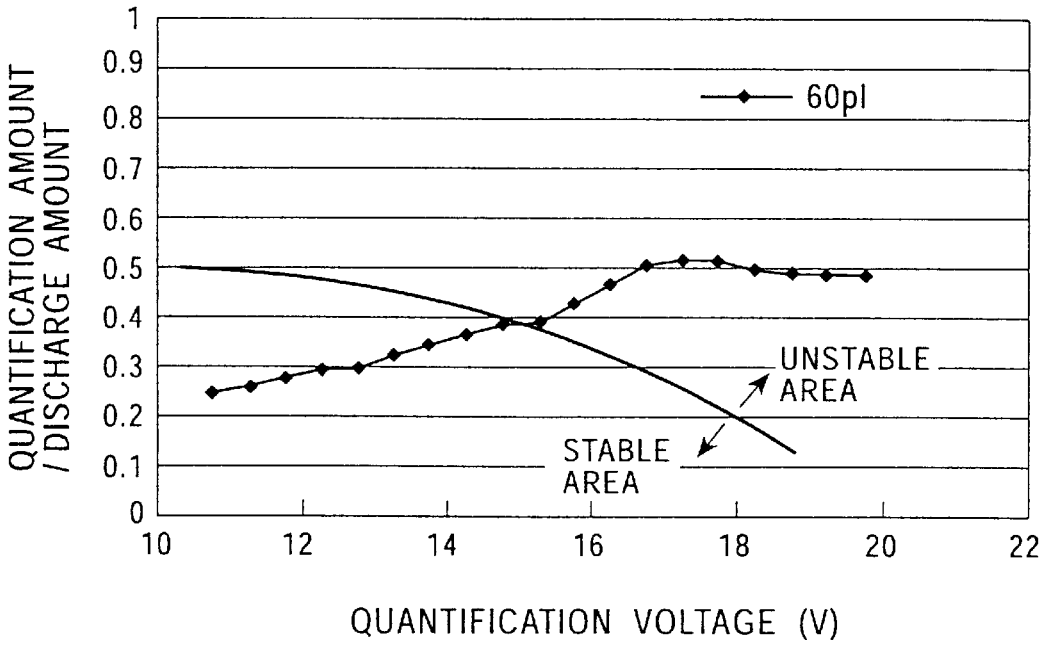
FIG. 27 is a chart illustrating results of an experiment using the printer head shown in FIG. 21, showing mixing ratios of the quantification medium to the discharge medium according to the driving voltage of the quantification medium.
Figure 28A:
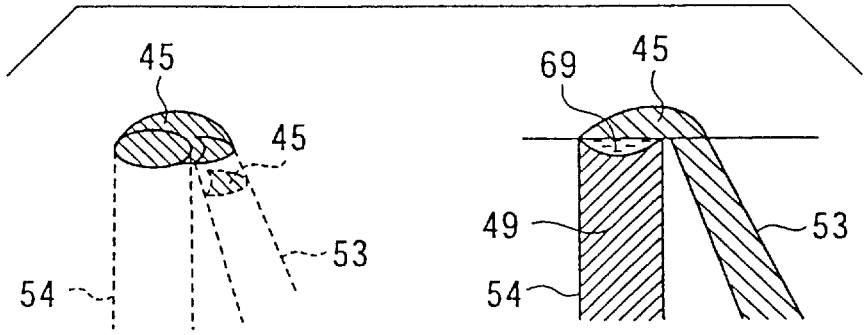
FIGS. 28(A)–28(C) are mimetic views showing a phenomenon that occurs in the vicinity of the quantification medium nozzle and the discharge medium nozzle in the unstable area of the printer head of FIG. 21.
Figure 28B:
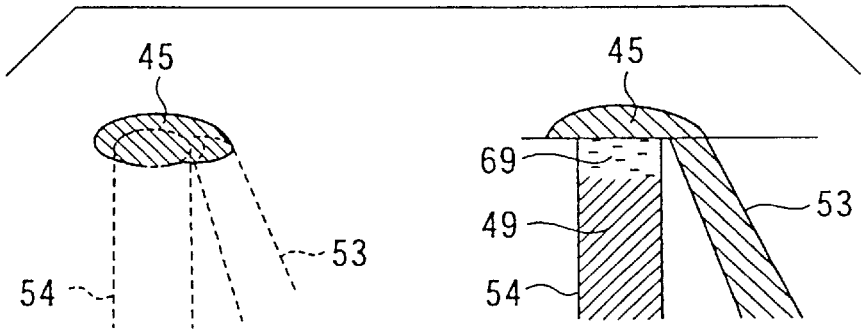
Figure 28C:
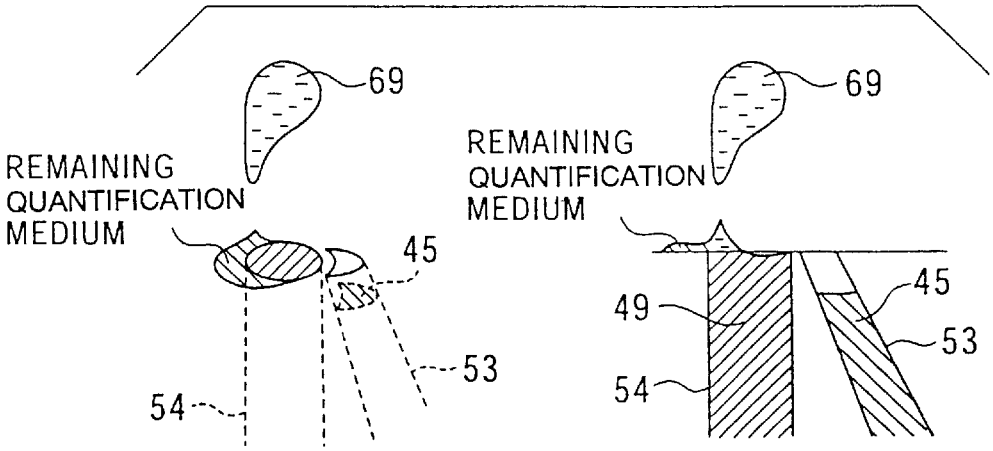

In other words, the mixing ratio of the quantification medium 45 included in the discharged liquid droplets can be increased. Although the upper limit of the conventional mixing ratio of ink is about 40–50% for obtaining the stable discharging (see FIG. 27), as shown in FIG. 18, the mixing ratio of about 80% can be obtained as the maximum percentage according to the driving method of the present invention.

In the case where ink is used as the quantification medium 45 and the diluent is used as the discharge medium 49, recording in higher density can be realized. Or, the density of coloring material of ink can be set as a lower density for obtaining the same density. This fact makes it very advantageous to design the ink in respect of bodying owing to the deposition or precipitation of a dye or a pigment, or dehydration.

Although a dye having a high resistance to light, e.g. a dye of cyan of the phtalocyanine group, has a tendency to make the printing density low, such a dye can be used according to the present invention because present invention can set the mixing ration to be high. Even if such a dye is used, practical printing densities can be obtained by the present invention.

Furthermore, since the quantification medium 45 is forcibly pulled into the discharge medium nozzle 54, the quantified quantification medium 45 can be discharge without waiting being pulled into the discharge medium nozzle 54 by the surface tension as in the prior art. Consequently, the period of discharging can be shortened by the waiting time, and then the time required for printing can be shortened.

Now, for positively producing the phenomenon that the quantification medium 45 flows into the discharge medium nozzle 54 when the mixed solution is produced by combining the quantification medium 45 and the discharge medium 49 as shown in FIG. 11(C), the operation on the discharge medium 49 side during points of time indicated the reference numerals (3)–(7) in FIG. 10 is preferred to be executed while the operation on the quantification medium 45 side during points of time indicated by reference numerals (2)–(7) in FIG. 10 is executed.

Figure 14:
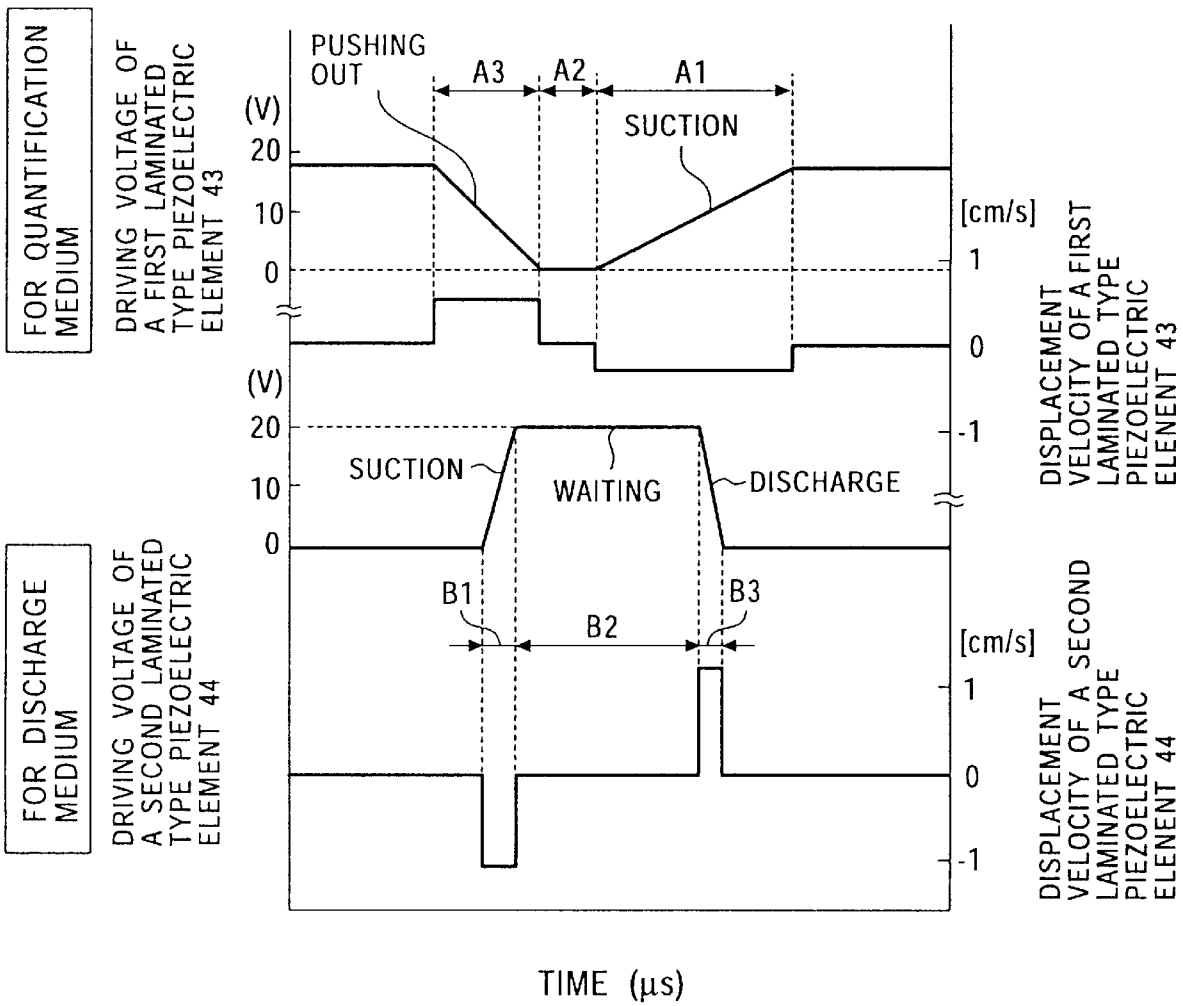
FIG. 14 is a diagram showing experimental examples of driving waveforms of the piezoelectric elements used in the printer head shown in FIG. 1 as pressure generating elements for a period and the displacement velocities of the piezoelectric elements.

FIG. 14 shows experimental examples of driving waveforms of the piezoelectric elements used in the printer head shown in FIG. 1 as pressure generating elements for a period and the displacement velocities of the piezoelectric elements. As shown in FIG. 14, for the first piezoelectric element 43, period A3 designates a pushing out time, period A2 designates a waiting time, and period A3 designates a suction time. For the second piezoelectric element 44, period B1 designates a suction time, period B2 designates a waiting time, and period B3 designates a discharge time.

Figure 15:
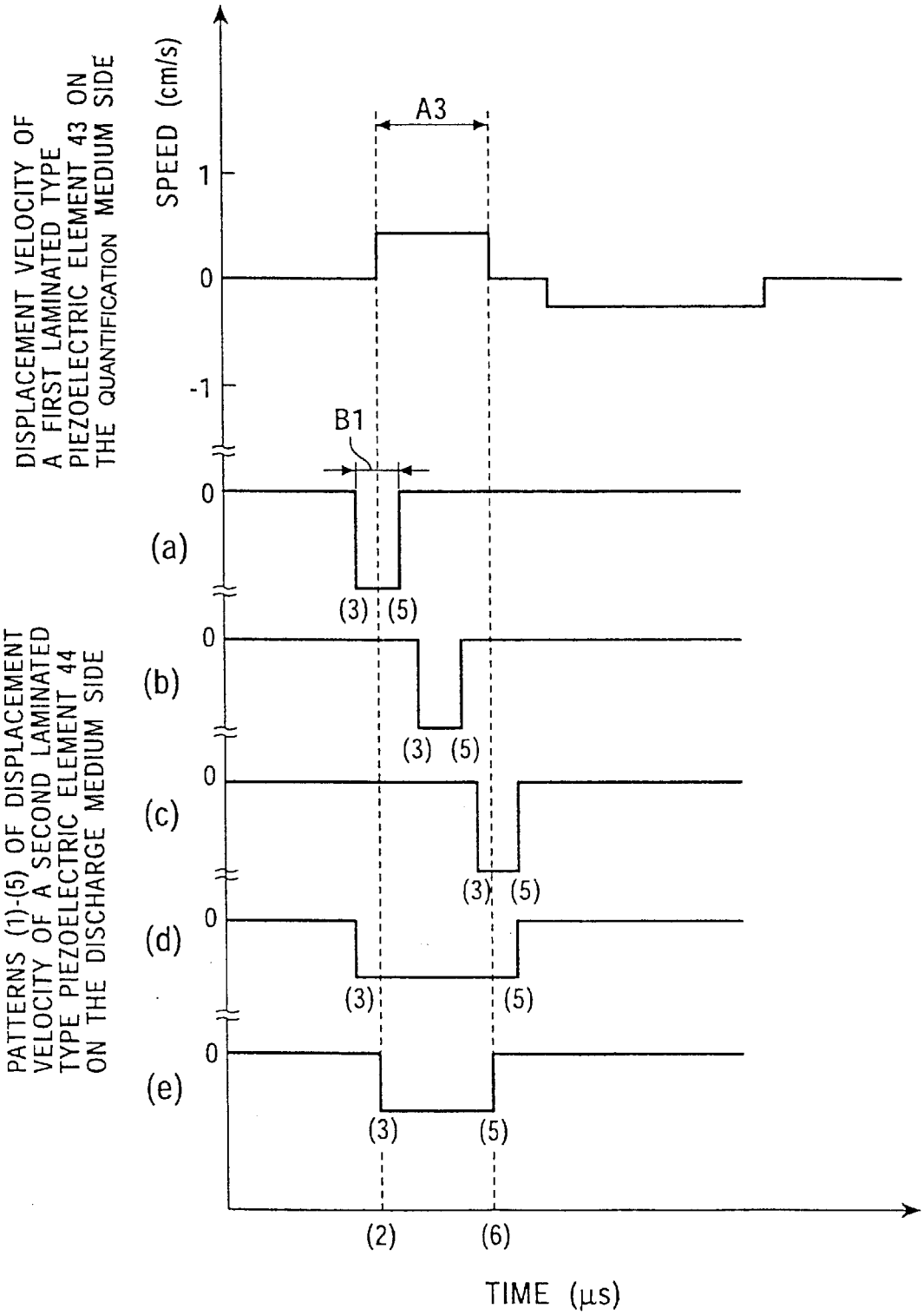
FIG. 15 is a diagram showing an example of relationships between the displacement velocities of the piezoelectric elements each on the quantification medium side and on the discharge medium side, in particular, showing the relationships between the A3 time of the displacement velocity on the quantification medium side and the B1 time of the displacement velocity on the discharge medium side.

FIG. 15 shows a fact that relationships between the displacement velocities of the first piezoelectric element 43 and the second piezoelectric element 44, in particular, the relationships between A3 period, i.e. during points of time indicated by reference numerals (2)–(6), and B1 period, i.e. during points of time indicated by reference numeral (3)–(5), can be examined on the following five kinds of patterns a–e.

a: (3)→(2)→(5)→(6)((3)<(2), (2)≦(5)<(6))

b: (2)→(3)→(5)→(6)((3)≧(2), (5)≦(6))

c: (2)→(3)→(6)→(5)((2)≦(3)≦(6), (5)>(6))

d: (3)→(2)→(6)→(5)

e: (3)→(2)→(6)→(5)((3)<(2), (5)≧(6))

Incidentally, it is supposed that the relationship, (3)<(5), is always satisfied owing to the structure of the waveforms.

By driving the piezoelectric elements 43 and 44 at the timing in conformity with the waveforms shown in FIG. 15, the quantification medium 45 flows into the discharge medium nozzle 54 for periods of time indicated by reference numerals (2)–(5) in case of a in FIG. 15, periods of time indicated by reference numerals (3)–(5) in case of b in FIG. 15, periods of time indicated by reference numerals (3)–(6) in case of c in FIG. 15, periods of time indicated by reference numerals (2)–(6) in case of d in FIG. 15, and periods of time indicated by reference numerals (2)–(6) in case of e in FIG. 15.

Figure 16:
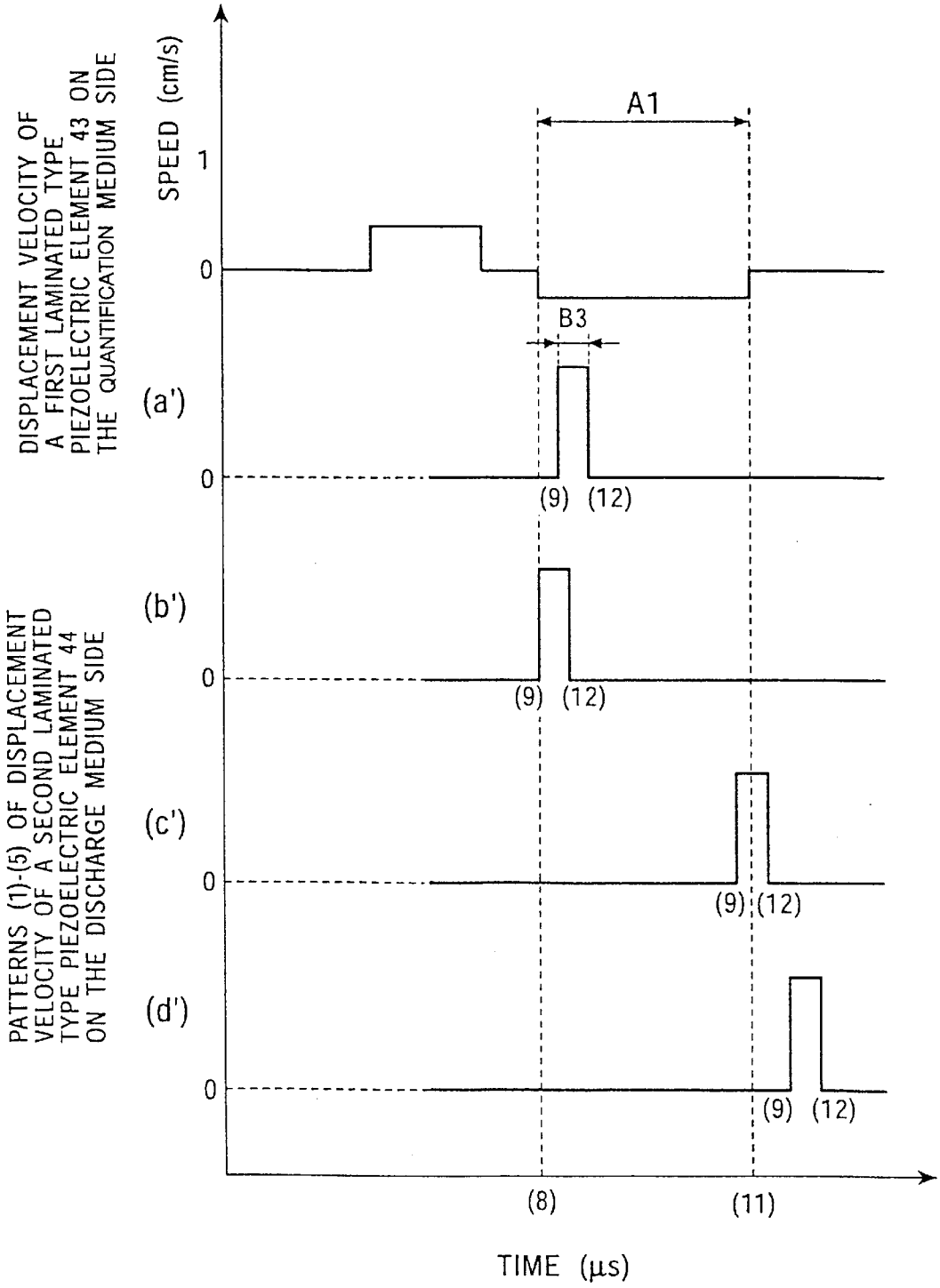
FIG. 16 is a diagram showing an example of relationships between the displacement velocities of the piezoelectric elements each on the quantification medium side and on the discharge medium side, in particular, showing the relationships between the A1 time of the displacement velocity on the quantification medium side and the B3 time of the displacement velocity on the discharge medium side.

In addition, for stabilizing the direction of the discharged mixed solution 69, the operation for separating the connection between the quantification medium 45 and the discharge medium 49 on the surface 41*b* of the nozzle plate 41, as shown in FIG. 12(C), is preferred to be executed positively, namely an operation for separating the connection is required to be executed such as an operation for periods of time indicated by reference numerals (8)–(9) in FIG. 16, which will be described later, on the quantification medium 45 side and an operation for periods of time indicated by reference numerals (9)–(12) in FIG. 16 on the discharge medium 49 side.

FIG. 16 shows a fact that relationships between the displacement velocities of the first piezoelectric element 43 and the second piezoelectric element 44, in particular, the relationships between A1 period, i.e. during points of time indicated by reference numerals (8)–(11), and B3 period, i.e. during points of time indicated by reference numeral (9)–(12), can be examined on the following four kinds of patterns a'–d'.

a': (8)→(9)→(12)→(11)((8)≦(9), (12)<(11))

b': (8)→(9)→(11)→(12)((9)<(11), (12)≧(11))

c': (8)→(11)→(9)→(12)((9)≧(11))

d': (9)→(12)

The quantification medium 45 is pulled into the quantification medium 53 from the surface 41*b* of the nozzle plate 41 into the quantification medium nozzle 53, and the first piezoelectric element 43 and the second piezoelectric element 44 are operated so that bubbles are not mixed into the quantification medium nozzle 53.

The operation of discharging the discharge medium 49 is executed while the quantification medium 45 is pulled into the quantification medium nozzle 53 in case of a' in FIG. 16 because periods of time indicated by reference numerals (9) and (12) are within the periods of time indicated by reference numerals (8)–(11).

In case of b' and c' in FIG. 16, the operation of discharging the discharge medium 49 starts at a point of time for the operation of pulling the quantification medium 45 into the quantification medium nozzle 53 during a period of time indicated by reference numerals (8)–(11) and ends at a point of time after the operation of pulling the quantification medium 45 ended ((11)–(12)).

In case of d' in FIG. 16, the operation of discharging the discharge medium 49 is performed after the mixed solution 69 and the quantification medium 45 is separated by pulling the quantification medium 45 into the quantification medium nozzle 53 for periods of time indicated by reference numerals (8)–(11).

The operations performed in conformity with the timing chart of each pattern of a', b', c' and d' in FIG. 16 may be done so that the mixed solution 69 is discharged in the direction of the discharge medium nozzle 54, i.e. the normal direction to the surface 41*b* of the nozzle plate 41, in a state that the meniscus is completely separated from the quantification medium 45.

Figure 17A:
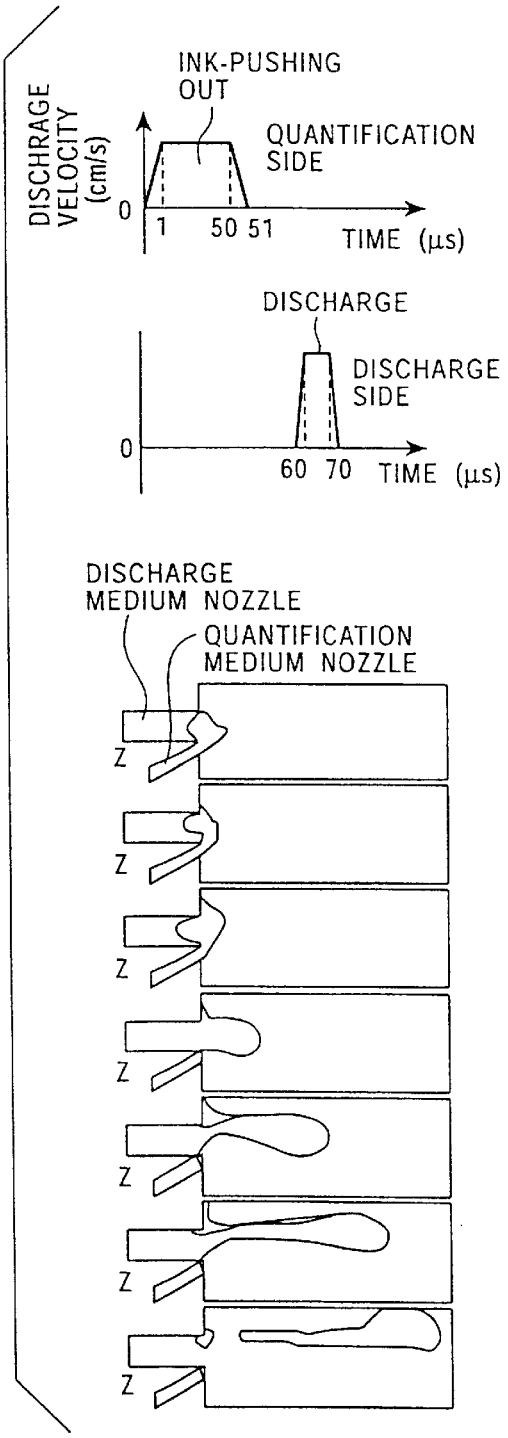
FIGS. 17(A) and 17(B) are diagrams showing examples of simulation results of the discharge of the mixed solution of the quantified medium and the discharge medium in comparison of the conventional driving method (FIG. 17(A)) and the driving method of the present invention (FIG. 17(B))
Figure 17B:
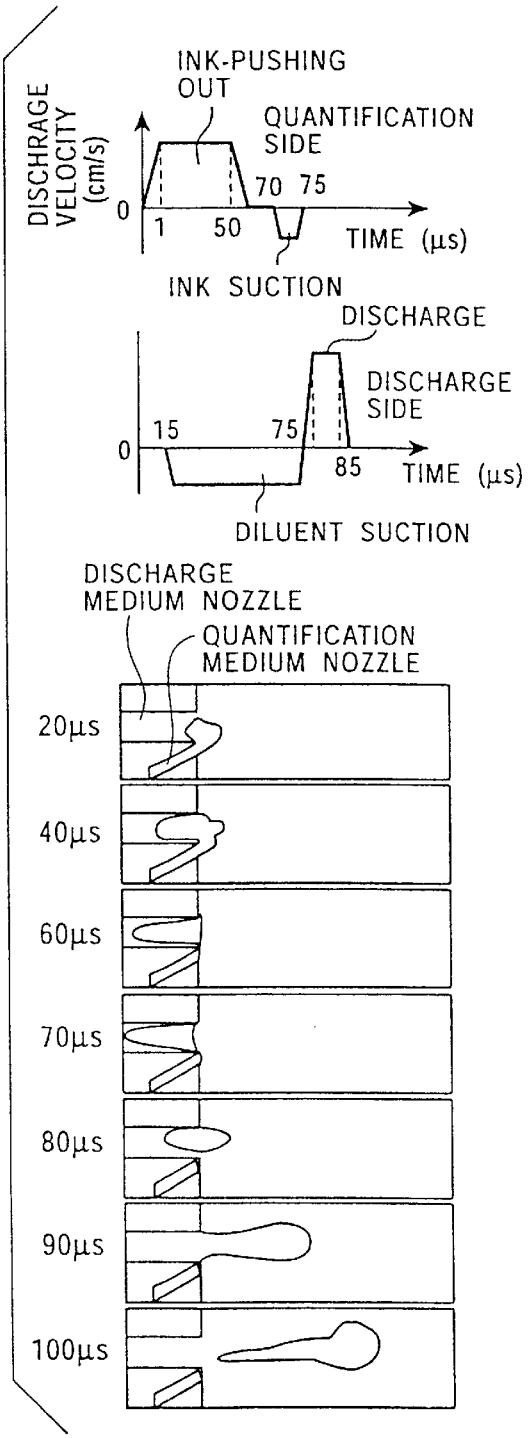

FIGS. 17(A) and 17(B) shows simulation results of the discharge of the mixed solution 49 in comparison of the conventional driving method and the driving method of the present invention.

FIG. 17(A) is a diagram showing the simulation results of the discharge of the mixed solution 49 in accordance with the conventional driving method. By setting the time when the quantification begins to be 0, the quantified ink overflows onto the opposite side of the discharge medium nozzle 54 to the quantification medium nozzle 53 at the time of 40 μs. The overflowed ink remains after discharging at the time of 100 μs. It is also known that liquid droplets are drawn to the remaining ink to curve the direction of discharging of the liquid droplets to the direction of the remaining ink.

FIG. 17(B) is a diagram showing the simulation results of the discharge of the mixed solution 49 in accordance with the driving method of the present invention. The overflow of ink is prevented by pulling the quantified ink into the discharge medium nozzle 54 for a period of 15 μs–75 μs together with diluent, i.e. discharge medium 49. Furthermore, the diluent and the ink are completely separated by pulling the ink for a period 70 μs–75 μs after quantification. As the result, there remains no mixed ink, and the mixing ration of the ink can be set to be high. Furthermore, the discharging direction of the liquid droplets is enhanced to go straight on. Incidentally, in the present simulation, the amount of pushing of the ink is supposed to be 30 pl, and the amount of discharging is supposed to be 60 pl.

Figure 19:
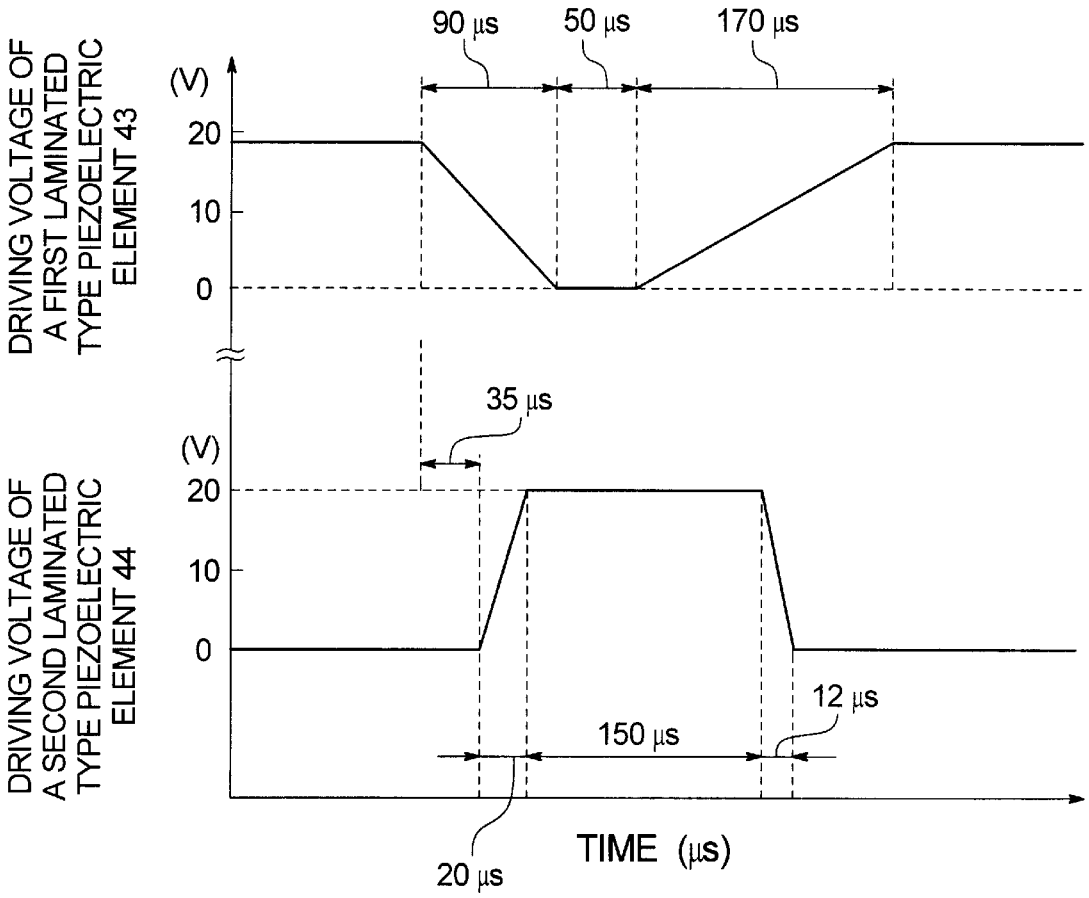
FIG. 19 is a timing chart showing waveforms of driving voltages applied to the piezoelectric elements of the printer head shown in FIG. 1.

FIG. 19 shows waveforms of driving voltages according to a driving method of the present invention. The waveforms correspond to the cases of c in FIG. 15 and a' in FIG. 16.

Executing an experiment according to the driving method of an embodiment of the present invention results in the data as shown in FIG. 18. The results indicate that the mixing ratio of ink can be heighten up to about 80% with keeping the stable discharge, in comparison with conventional data shown in FIG. 27.

The ink as the quantification medium 45 and the diluent as the discharge medium 49 in the printer of the embodiment may have the following composition and properties.

| <COMPOSITION> | |
|---|---|
| C. I. acid blue 9 | 8 weight % |
| N-methyl-2-pyrrolidone | 10 weight % |
| ethylene glycol mono-methyl ether | 10 weight % |
| surface active agent | 0.01 weight % |
| water | 81.99 weight % |
| <PROPERTIES> | |
| viscosity | 2 cp |
| surface tension | 30 dyne/cm at 20° C. |

On the other hand, the diluent may have the following composition and properties.

| <COMPOSITION> | |
|---|---|
| isopropyl alcohol | 7 weight % |
| diethylene glycol | 23 weight % |
| water | 70 weight % |

-continued

| <PROPERTIES> | |
|---|---|
| viscosity | 2.2 cp |
| surface tension | 40 dyne/cm at 20° C. |

Although it was described that the embodiment uses the cyano-colored dye, it need scarcely be said that other colors may be used. Ordinary paper, paper for ink jet printers on the market may be used as the material to be printed thereon.

<EMBODIMENT OF THREE COLORS MIXED HEAD>

Figure 20:
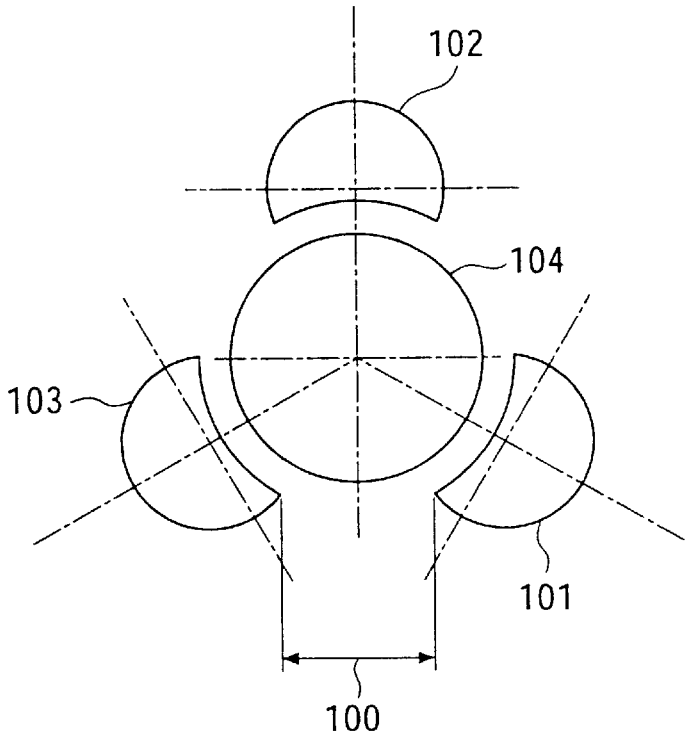
FIG. 20 is a top view of an example of nozzle portion of a three colors mixing type carrier jet head type printer head.
Figure 21:
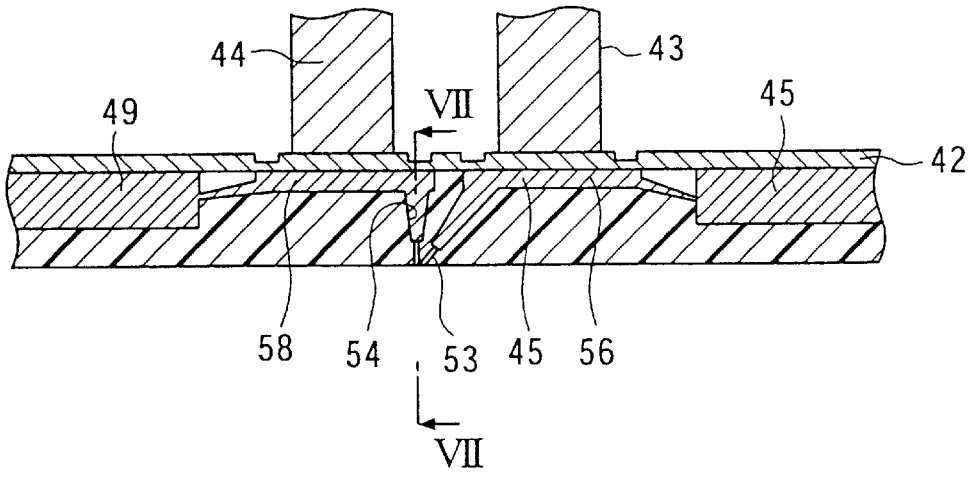
FIG. 21 is a sectional view of a conventional printer head.
Figure 22:
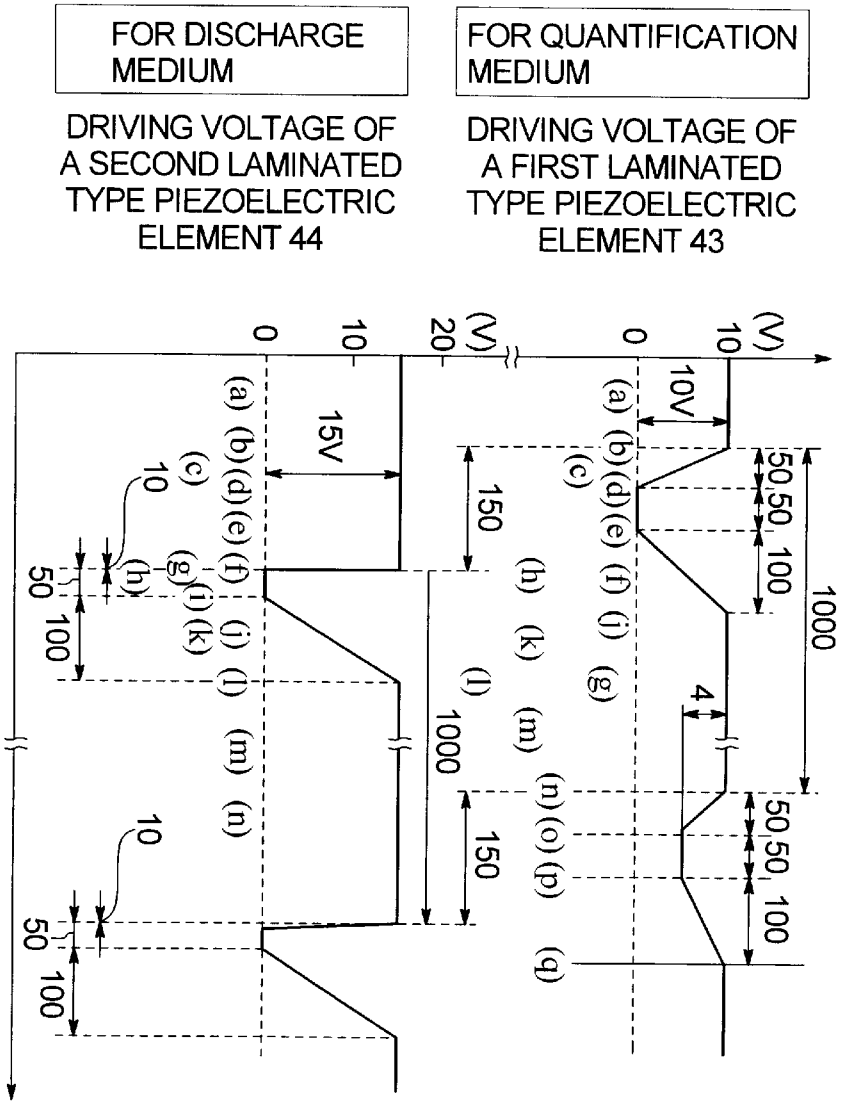
FIG. 22 is a timing chart showing driving voltages of the printer head of FIG. 21.
Figure 23A:
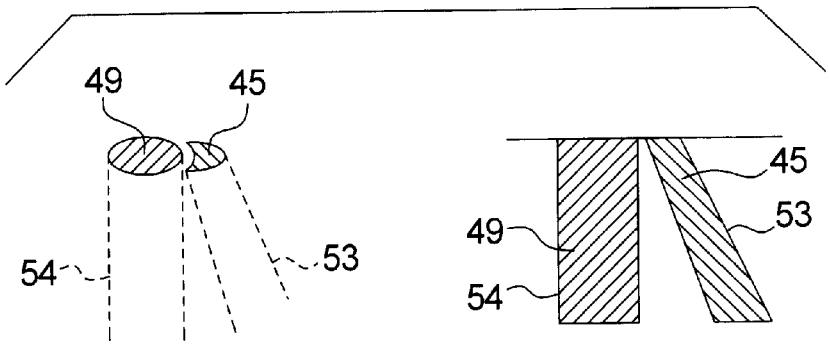
FIGS. 23(A)–23(C) are mimetic views showing a state of waiting, a state of discharging the quantification medium and a state of coupling of the quantification medium and the discharge medium in the printer head of FIG. 21, respectively.
Figure 23B:
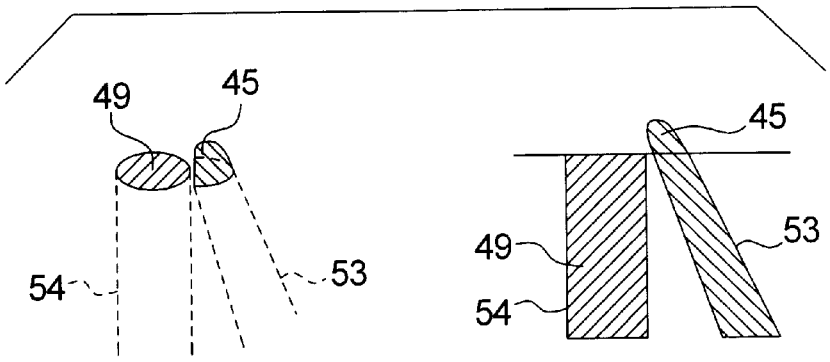
Figure 23C:
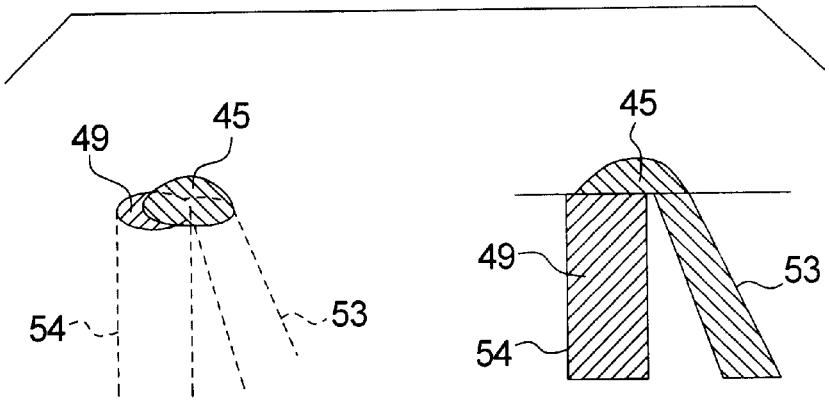
Figure 24A:
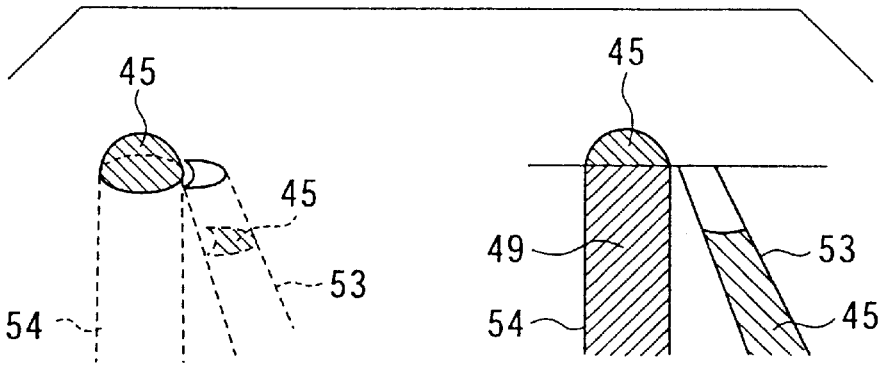
FIGS. 24(A)–24(C) are mimetic views showing a state that a part of the quantification medium is remaining on the discharge medium nozzle after being separated, a state that the part of the quantification medium was mixed with the discharge medium in the discharge medium nozzle, and the state that the mixed solution begins to be pushed out in the printer head of FIG. 21, respectively.
Figure 24B:
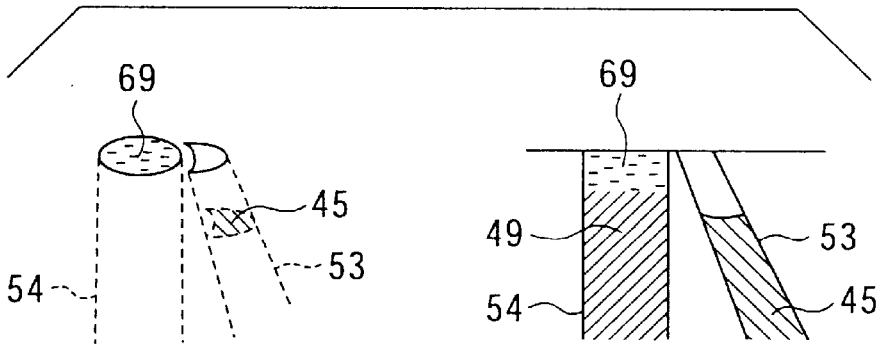
Figure 24C:
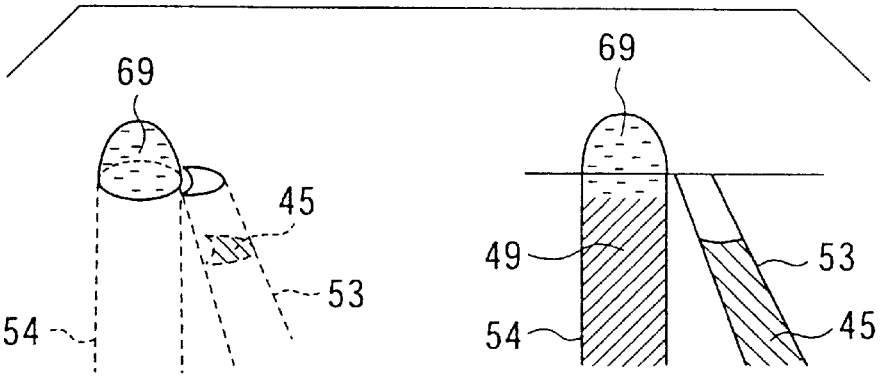
Figure 25A:
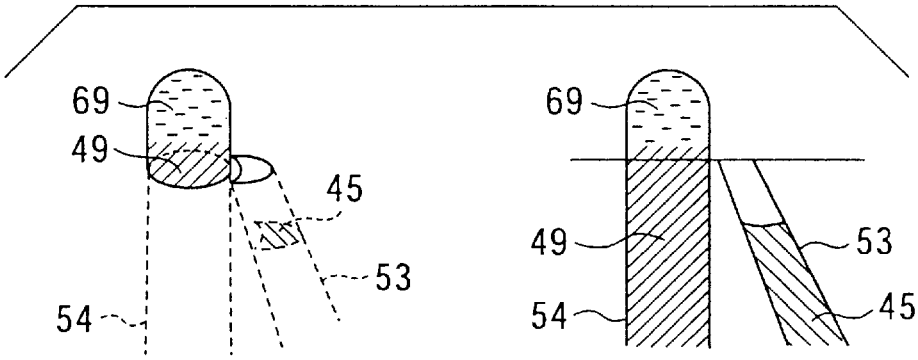
FIGS. 25(A)–25(C) are mimetic views showing a state that the mixed solution of the quantification medium and the discharge medium is pushed out, a state that a constriction begins to be produced between the mixed solution and the discharge medium, and a state that the mixed solution is discharged in the printer head of FIG. 21, respectively.
Figure 25B:
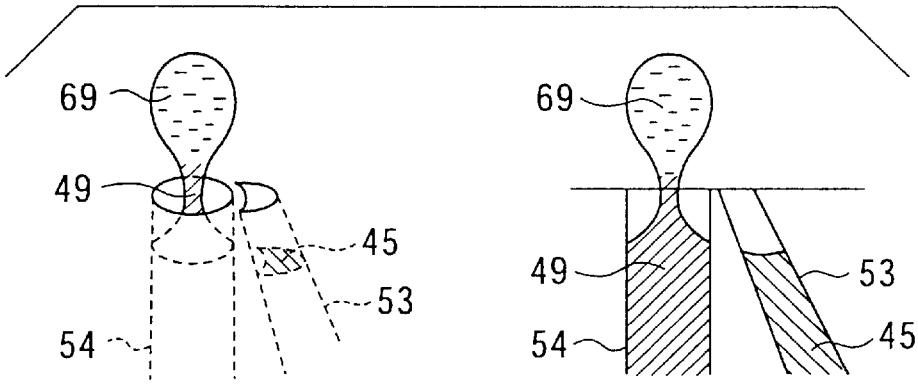
Figure 25C:
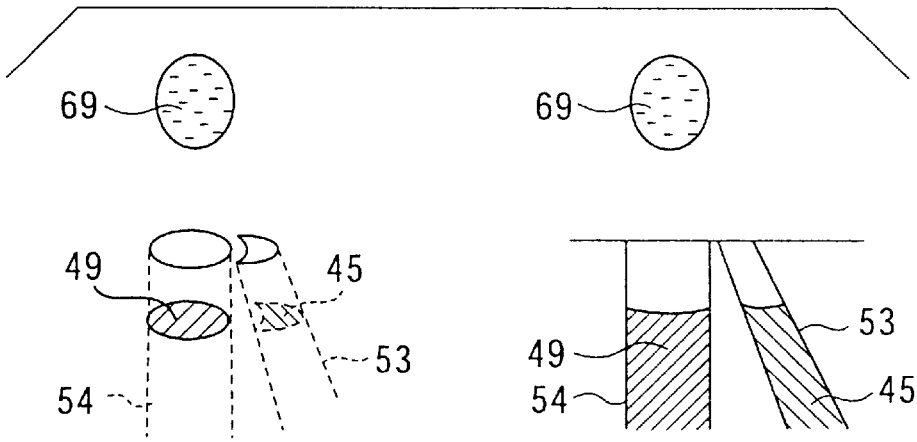
Figure 26A:
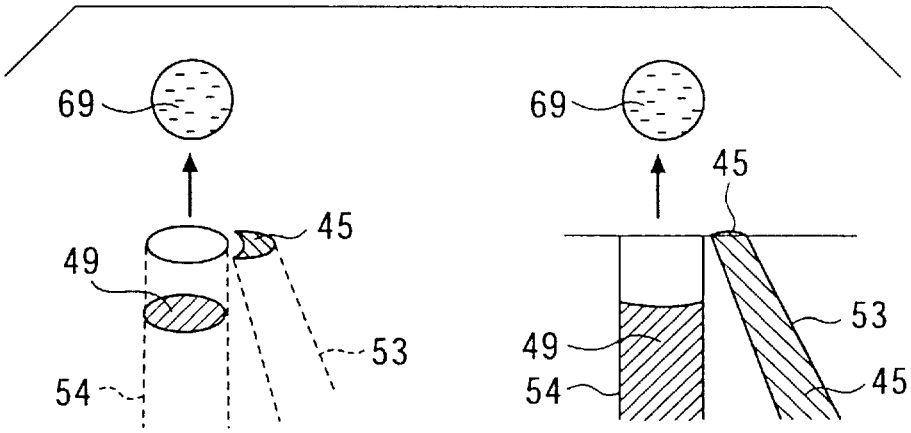
FIGS. 26(A)–26(C) are mimetic views showing a state that the mixed solution in a sphere continues to fly, a state that the discharge medium is re-plugged in the discharge medium nozzle to be swollen thereon, and a state that the discharge medium has returned to the waiting state thereof in the printer head of FIG. 21, respectively.
Figure 26B:
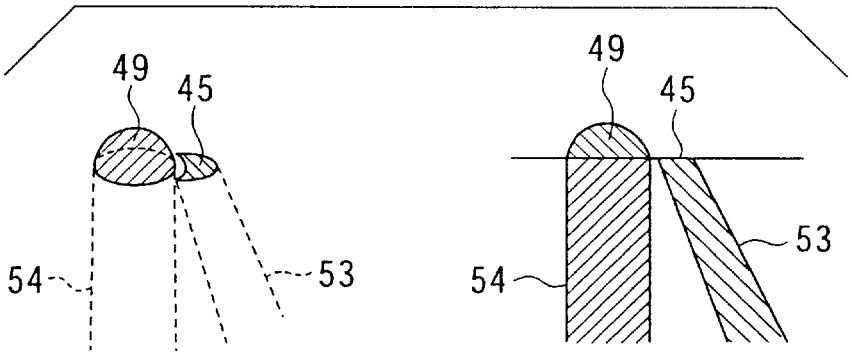
Figure 26C:
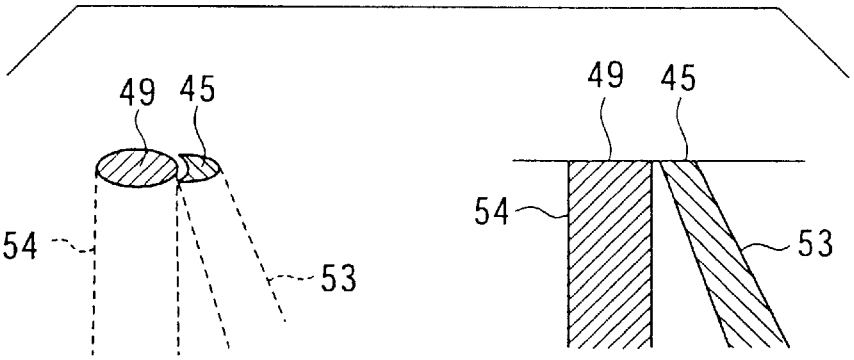

The driving method according to the present invention is effectively applicable to a multi-color mixing type carrier jet head equipped with quantification medium nozzles 101, 102, 103 having a crescent shape including a partially eclipsed part, which nozzles are disposed in order around the discharge medium nozzle 104 for three colors of cyan blue, magenta and yellow, respectively, or for four colors including black together with the aforesaid three colors, as shown in FIG. 20, which carrier jet head begins discharging mixed solution for printing after mixing three or four colors in a discharge medium nozzle 104.

In such a structure as that of the aforementioned printer head, the distance between the adjacent quantification media 100 is short, and thereby unnecessary color mixing easily happens owing to the overflow of the quantification media and the discharge medium in the vicinity of the outlets of the nozzles 101–104. However, according to the driving method of the present invention, because the smooth flow of the quantification media to the vicinity of the discharge medium nozzle 101 can be formed, the overflow of quantification media does not occur. Consequently, picture printing without color mixing between quantification media is enabled.

And then, the quantification medium to be mixed with the discharge medium is pushed out of the quantification medium nozzle corresponding to it. On the other hand, the quantification media that are not mixed with the discharge medium are pulled into the quantification medium nozzles corresponding to them, respectively. And then, the piezoelectric element as a pressure generating element discharge the discharge medium to be mixed from the discharge medium nozzle 104. Consequently, unnecessary color mixing can be prevented.

In an ink jet printer according to the present invention, a laminated type piezoelectric element is used as the pressure generating means, other pressure generating means such as the so-called veneer piezoelectric element, a heating element and a magnetostrictive element may be used. It is also capable that different kinds of pressure generating means are used on the quantification side and the discharge side, respectively.

Incidentally, in the ink jet printer according to the present invention, aforementioned examples can be used as a combination of them. Various variations are of course applicable without departing from the sprit of the present invention.

As description was made about a serial type printer as an embodiment of the invention, it goes without saying that the present invention is applicable to a line type printer or a drum type printer.

The following advantages can be obtained by using the driving method of an embodiment of the invention.

ENHANCEMENT OF THE AMOUNT OF QUANTIFICATION

As shown in FIG. 18, the mixing ratio of the quantification medium in a stable area is enhanced. In comparison with a slow flow of the quantification medium into the discharge medium nozzle owing to the capillary force as in the prior art, it is capable of generating a rapid flow of the quantification medium into the discharge medium nozzle actively. Consequently, a large quantity of quantification medium can be quantified for one period in comparison with the prior art.

IMPROVEMENT OF FREQUENCY CHARACTERISTICS

As mentioned above, by producing a rapid flow of the quantification medium, reproduction of high density becomes possible during a short period, according to the present invention. That is, it becomes possible to increase the driving frequency of a head.

CAPABILITY OF USING INK IN MORE STABLE STATE

Coloring ability tends to be enhanced when the density of a dye included in ink is high. On the other hand, the dye is easy to be saturated and to be deposited in the ink when the density is high. Because ink can be used in a state that the density of the dye included in the ink is lowered than that of the prior art when a great deal of the ink can be quantified at the time of realizing the maximum density thereof, it becomes possible to use the ink in a stable area.

WIDENING OF RANGE OF APPLICABLE DYES

Even if a dye is unstable and easy to be saturated, the desired maximum density can be expressed by using ink in a stable low density of the dye and quantifying a great deal of the ink.

DECREASE IN COLOR MIXING IN MULTI COLORS MIXING TYPE CARRIER JET HEAD

Performing a quantification operation with flow decreases the overflow of the quantification medium around a nozzle. Consequently, the contact of each medium between adjoining quantification nozzles decreases to decrease unnecessary color mixing in turn.

DECREASE DIFFERENCES BETWEEN NOZZLES

In prior art, the quantification medium is once accumulated on the discharge medium nozzle, and then the accumulated quantification medium is pulled into the discharge medium nozzle by a capillary force for discharging the mixed liquid. That is, the operation of "accumulation" is required in a cycle. However, according the present invention, the "accumulation" operation becomes unnecessary. The "accumulation" operation is strongly influenced by surface processing such as a repellent treatment around the discharge medium nozzle. When the effect of the repellent treatment is strong, the amount of the quantification medium capable of being accumulated, i.e. capable of being quantified, becomes much, and when the repellent treatment is not done, the quantification medium becomes easy to overflow and then the amount of the quantification medium capable of being accumulated becomes small. Furthermore, the repellent treatment is easy to produce differences between respective nozzles owing to the wear produced by the cleaning operation of a head and deterioration by aging.

Hence, the driving method according to the present invention without the "accumulation" operation can decrease the influences of the differences caused by the repellent treatment, and thereby can decrease the variation of the discharge direction due to the overflow and the cases where the mixed liquid is not discharged.

According to the conventional method for driving a carrier jet head, ink pushed out of the quantification medium nozzle is mounted on the discharge medium nozzle, and then the quantification medium is pulled into the nozzle by the capillary force to be discharged. If ink more than a certain amount is tried to be quantified, the ink that cannot mount on the discharge medium nozzle overflows. As a result, phenomena such as disturbances of the direction of discharging and no discharging occur.

However, according to the present invention, even if the amount of the ink to be quantified is large, the ink does not overflow around the nozzle.

Although the invention has been described in its preferred form with a certain degree of particularity, obviously many changes and variations are possible therein. It is therefore to be understood that the present invention may be practiced otherwise than as specifically described herein without departing from the scope and the sprit thereof.

What is claimed is:

1. A printer head in an ink jet printer, comprising:

a quantification medium pressuring chamber where a quantification medium is introduced;

a discharge medium pressuring chamber where a discharge medium is introduced;

a quantification medium nozzle communicating with said quantification medium pressuring chamber;

a discharge medium nozzle communicating with said discharge medium pressuring chamber, said discharge medium nozzle being disposed to adjoin said quantification medium nozzle; and a first pressure generating element pulling said quantification medium pushed out of said quantification medium nozzle into said discharge medium nozzle to form a mixed solution by contacting said quantification medium in said discharge medium nozzle through a surface where said quantification medium nozzle opens, wherein said first pressure generating element then generates a pressure for discharging said mixed solution from said discharge medium nozzle.

2. A printer head according to claim 1, wherein said first pressure generating element pulls said quantification medium into said discharge medium nozzle by making an inside of said discharge medium nozzle a negative pressure state that is lower than atmospheric pressure, and said quantification medium is pushed out of said quantification medium nozzle.

3. A printer head according to claim 1, wherein said first pressure generating element operates in a direction where said quantification medium is pulled into said discharge medium nozzle, and said quantification medium is pushed out of said quantification medium nozzle.

4. A printer head according to claim 1, wherein said quantification medium to be mixed with said discharge medium is pushed out of said quantification medium nozzle and a remaining non-mixed portion of the quantification medium is pulled back into the quantification medium nozzle, and after that, said first pressure generating element makes said discharge medium nozzle discharge said discharge medium.

5. A printer head according to claim 4, said printer head further comprising a second pressure generating means operating in a direction to push out said quantification medium to be mixed with said discharge medium out of said quantification nozzle and to pull the remaining non-mixed portion of the quantification medium back into the quantification medium nozzle.

6. An ink jet printer equipped with a printer head, wherein said printer head comprising:

a quantification medium pressuring chamber where a quantification medium is introduced;

a discharge medium pressuring chamber where a discharge medium is introduced;

a quantification medium nozzle communicating with said quantification medium pressuring chamber;

a discharge medium nozzle communicating with said discharge medium pressuring chamber, said discharge medium nozzle being disposed to adjoin said quantification medium nozzle; and a first pressure generating element pulling said quantification medium pushed out of said quantification medium nozzle into said discharge medium nozzle to form a mixed solution by contacting said quantification medium in said discharge medium nozzle through a surface where said quantification medium nozzle opens, wherein said first pressure generating element then generates a pressure for discharging said mixed solution from said discharge medium nozzle.

7. An ink jet printer equipped with a printer head according to claim 6, wherein said first pressure generating element pulls said quantification medium into said discharge medium nozzle by making an inside of said discharge medium nozzle a negative pressure state that is lower than atmospheric pressure, and said quantification medium is pushed out of said quantification medium nozzle.

8. An ink jet printer equipped with a printer head according to claim 6, wherein said first pressure generating element operates in a direction where said quantification medium is pulled into said discharge medium nozzle, and said quantification medium is pushed out of said quantification medium nozzle.

9. An ink jet printer equipped with a printer head according to claim 6, wherein said quantification medium to be mixed with said discharge medium is pushed out of said quantification medium nozzle and a remaining non-mixed portion of the quantification medium is pulled back into the quantification medium nozzle, and after that, said first pressure generating element makes said discharge medium nozzle discharge said discharge medium.

10. An ink jet printer equipped with a printer head according to claim 9, said printer head further comprising a second pressure generating means operating in a direction to push out said quantification medium to be mixed with said discharge medium out of said quantification nozzle and to pull the remaining non-mixed portion of the quantification medium back into the quantification medium nozzle.

11. A method for driving a printer head, said method comprising the steps of:

moving a quantification medium pushed out of a quantification medium nozzle from said quantification medium nozzle to a discharge medium nozzle through a surface where said quantification medium nozzle opens;

forming a mixed solution by pulling said quantification medium into said discharge medium nozzle to contact with said discharge medium in said discharge medium nozzle; and discharging said mixed solution from said discharge medium nozzle.

12. A method for driving a printer head according to claim 11, wherein said pulling said quantification medium into said discharge medium is performed by making an inside of said discharge medium nozzle a negative pressure state that is lower than atmospheric pressure with a first pressure generating element.

13. A method for driving a printer head according to claim 11, wherein said pulling of said quantification medium into said discharge medium is performed by means of a first pressure generating element.

* * * * *